US008861771B2

(12) United States Patent
Stott

(10) Patent No.: US 8,861,771 B2
(45) Date of Patent: Oct. 14, 2014

(54) APPARATUS AND SYSTEM FOR PLAYING AUDIO SIGNALS FROM AN AUDIO SOURCE

(76) Inventor: Alan Stott, West Valley City, UT (US)

( * ) Notice: Subject to any disclaimer, the term of this patent is extended or adjusted under 35 U.S.C. 154(b) by 87 days.

(21) Appl. No.: 13/488,063

(22) Filed: Jun. 4, 2012

(65) Prior Publication Data

US 2012/0308069 A1 Dec. 6, 2012

Related U.S. Application Data

(60) Provisional application No. 61/493,218, filed on Jun. 3, 2011.

(51) Int. Cl.
*H04R 25/00* (2006.01)

(52) U.S. Cl.
USPC ..... 381/380; 381/370; 181/129

(58) Field of Classification Search
USPC ..... 381/370, 182, 371, 367, 322, 333, 186, 381/380, 381; 181/129, 134, 135, 137; 455/575.1
See application file for complete search history.

(56) References Cited

U.S. PATENT DOCUMENTS

| | | | | |
|---|---|---|---|---|
| 671,138 | A | 4/1901 | Knudson et al. | |
| 2,477,046 | A | 7/1949 | Davenport | |
| 3,851,123 | A | 11/1974 | Lipinski et al. | |
| 5,412,736 | A | 5/1995 | Keliiliki | |
| D372,312 | S * | 7/1996 | Lange | D24/174 |
| 6,097,827 | A | 8/2000 | Yang | |
| 6,427,018 | B1 | 7/2002 | Keliiliki | |
| 7,013,018 | B2 | 3/2006 | Bøgeskov-Jensen | |
| 7,206,429 | B1 | 4/2007 | Vossler | |
| D627,337 | S | 11/2010 | Wu et al. | |
| 2005/0207606 | A1 * | 9/2005 | Yang | 381/370 |
| 2007/0054703 | A1 | 3/2007 | Ryann | |
| 2008/0159548 | A1 * | 7/2008 | Solum | 381/58 |
| 2008/0311966 | A1 * | 12/2008 | Klein | 455/575.2 |
| 2009/0202096 | A1 | 8/2009 | Ryann | |

FOREIGN PATENT DOCUMENTS

| | | | |
|---|---|---|---|
| CN | 2904525 | | 5/2007 |
| CN | 201142755 | | 10/2008 |
| EP | 1571872 | A1 | 9/2005 |
| EP | 1887829 | A1 | 2/2008 |
| GB | 2464990 | | 5/2010 |
| JP | 58076288 | | 5/1983 |
| JP | 4152000 | | 5/1992 |
| JP | 9065474 | | 3/1997 |
| JP | 10243492 | | 9/1998 |
| JP | 2002034089 | | 1/2002 |
| KR | 20080073155 | | 8/2008 |
| WO | 2005053352 | A1 | 6/2005 |
| WO | 2010005039 | A1 | 1/2010 |
| WO | 2011025163 | A2 | 3/2011 |

* cited by examiner

*Primary Examiner* — Curtis Kuntz
*Assistant Examiner* — Sunita Joshi
(74) *Attorney, Agent, or Firm* — Goucher Patent Law; Tyler Goucher

(57) ABSTRACT

An apparatus and system to play audio signals from an audio source is disclosed. The apparatus is positionable within a fistula defining a channel extending through a pinna of an ear of a user from a first surface of the pinna to a second surface of the pinna such that the channel extends through an entire width of the pinna. The apparatus includes a housing, a speaker, and an audio signal receiving member. The housing is positionable within the channel in the ear of the user and includes an enclosure defining a speaker receiving space. The speaker is positioned within the speaker receiving space. In an engaged position, at least a portion of the speaker is positioned within the channel in the ear of the user. The audio signal receiving member is electrically coupled to the speaker and is communicably coupleable with the audio source.

16 Claims, 16 Drawing Sheets

APPARATUS AND SYSTEM FOR PLAYING AUDIO SIGNALS FROM AN AUDIO SOURCE

CROSS-REFERENCES TO RELATED APPLICATIONS

This application claims the benefit of U.S. Provisional Patent Application No. 61/493,218 entitled "APPARATUS AND SYSTEM FOR PLAYING AUDIO SIGNALS FROM AN AUDIO SOURCE" and filed on Jun. 3, 2011 for Alan Stott, which is incorporated herein by reference.

FIELD

This subject matter relates to piercings and more particularly relates to audio systems positionable within piercings.

BACKGROUND

Portable personal audio players have become increasingly popular in recent years. These audio players typically include a storage device which stores digitally encoded music files. The music files are replayed through speakers in headphones positioned on or near a users ears. Typically these headphones are available in two types. One type includes an over-the-ear headphone which is positioned over the user's ears. The other type of headphones are in-ear headphones which include a speaker sized to be positioned within the user's ear canal.

Both the over-the-ear type headphones and the in-ear type headphones have drawbacks. Specifically, the over-the-ear type headphones are bulky and awkward to wear. The in-ear type headphones, being positioned within the user's ear canal, can cause irritation and discomfort to the user. Additionally, both the over-the-ear type headphones and the in-ear type headphones block out environmental sounds as they typically completely cover the user's ear canal. Blocking environmental sounds can place the user in a dangerous situation if the user is unable to hear environmental sounds for which the user should take action.

Body piercing has practiced by both males and females in various cultures throughout the world since ancient times. Piercing involves puncturing or cutting a part of the body to create an opening through which jewelry is positioned. The most common type of piercing is ear piercing.

Individuals with pierced ears, place jewelry through the piercings to ornament the individuals ears. Typical jewelry includes either a piece of jewelry that rests against a pinna of the users ear or hangs from the individuals earlobe. In either case, the addition of such jewelry increases a risk to the user that the jewelry may snag or otherwise be torn from the user's piercing.

"Gauging" or ear stretching has also been practiced by both males and females in various cultures throughout the world since ancient times. Ear stretching involves the deliberate expansion of a healed fistula or hole in the skin. Some individuals opt to stretch their piercings so that the jewelry can be entirely contained within the individuals piercing and thus avoid the problems associated with snagging or otherwise tearing jewelry from within the individuals piercing.

SUMMARY

From the foregoing discussion, it should be apparent that a need exists for an apparatus and system for playing audio signals from an audio source. Beneficially, such an apparatus and system would securely couple a speaker to a user's ear and would allow the user to hear environmental sounds.

The present subject matter has been developed in response to the present state of the art, and in particular, in response to the problems and needs in the art that have not yet been fully solved by currently available personal audio systems. Accordingly, the present subject matter has been developed to provide an apparatus and system for playing audio signals from an audio source that overcome many or all of the above-discussed shortcomings in the art.

In one embodiment, the apparatus to play audio signals from an audio source is positionable within a fistula defining a channel extending through a pinna of an ear of a user from a first surface of the pinna to a second surface of the pinna such that the channel extends through an entire width of the pinna.

The apparatus, in one embodiment, includes a housing, a speaker, and an audio signal receiving member. The housing is positionable within the channel defined by the fistula disposed in the pinna of the ear of the user. The housing includes an enclosure defining a speaker receiving space. The speaker is positioned within the speaker receiving space in the housing. In an engaged position, at least a portion of the speaker is positioned within the channel defined by the fistula disposed in the pinna of the ear of the user. The audio signal receiving member is electrically coupled to the speaker and is communicably coupleable with the audio source.

In certain embodiments, the housing includes a first end opposing a second end with the enclosure extending between the first end and the second end. The enclosure has a fistula engaging surface opposing a speaker receiving surface with the speaker receiving surface defining the speaker receiving space. In the engaged position, in an exemplary embodiment, the first end of the housing extends beyond the first surface of the pinna and the second end of the housing extends beyond the second surface of the pinna. In another embodiment, in the engaged position, at least a portion of the speaker is positioned between the first surface of the pinna and the second surface of the pinna.

In one embodiment, the speaker includes a magnet and a cone. In such an embodiment, the magnet is positioned within the channel defined by the fistula disposed in the pinna of the ear of the user. In another embodiment, at least a portion of the cone is positioned within the channel defined by the fistula disposed in the pinna of the ear of the user. In yet another embodiment, the entire cone is positioned within the channel defined by the fistula disposed in the pinna of the ear of the user.

In a further embodiment, the audio signal receiving member is a wireless communication module. In such an embodiment, the wireless communication module is configured to wirelessly couple with the audio source to receive audio signals.

In another embodiment, the audio signal receiving member includes at least one of a male electrical contact and a female electrical contact. In such an embodiment, the at least one of the male electrical contact and the female electrical contact are matingly coupleable with a corresponding at least one of an audio source male electrical contact and an audio source female electrical contact such that the speaker can receive audio signals from the audio source.

In certain embodiments, the speaker is a first speaker and the apparatus further includes a second speaker and a second audio signal receiving member. In such an embodiment, the second audio signal receiving member may be electrically coupled to the second speaker and communicably coupleable with the audio source such that the second speaker can receive audio signals from the audio source.

In one embodiment, at least a portion of the second speaker is positionable within a second channel defined by a second fistula disposed in the pinna of the ear of the user. In another embodiment, the first speaker is configured to play a first tonal range of sounds and the second speaker is configured to play a second tonal range of sounds with the first tonal range of sounds being a different tonal range than the second tonal range of sounds. In yet another embodiment, at least a portion of the second speaker is positionable within a second channel defined by a second fistula disposed in a second pinna of a second ear of the user such that the first and second speaker provide a stereo sound for the user.

The apparatus, in certain embodiment, also includes an adjustment member. In such an embodiment, the coupling between the audio signal receiving member and the audio source facilitates transfer of a track of sound from the audio source to the speaker and the speaker is configured to emit a sound. The adjustment member is configured to adjust at least one of the track of sound received from the audio source and a volume of the sound emitted from the speaker.

In certain embodiments, the housing is substantially cylindrical. In another embodiment, the apparatus includes a waterproof membrane surrounding the speaker such to allow the user to keep the apparatus positioned within the piercing in the user's ear while the user showers or bathes.

An apparatus for playing audio signals from an audio source is also disclosed which includes a housing positionable within a channel defined by the fistula disposed in the pinna of the ear of the user. The housing includes a first end opposing a second end and an enclosure extending between the first end and the second end. The enclosure includes a fistula engaging surface opposing a speaker receiving surface. The speaker receiving surface of the enclosure defines a speaker receiving space. In an engaged position the first end of the housing extends beyond the first surface of the pinna and the second end of the housing extends beyond the second surface of the pinna. A speaker is positioned within the speaker receiving space in the housing and, in the engaged position, the speaker is positioned between the first surface of the pinna and the second surface of the pinna. An audio signal receiving member is electrically coupled to the speaker and communicably coupleable with the audio source.

In certain embodiments, the apparatus also includes a second housing positionable within a second channel defined by a second fistula disposed in a second pinna of a second ear of the user. In such an embodiment, the second housing includes a second enclosure defining a second speaker receiving space. A second speaker is positioned within the second speaker receiving space in the second housing. In the engaged position, at least a portion of the second speaker is positioned within the second channel in the second ear of the user. The apparatus also includes a second audio signal receiving member which is electrically coupled to the second speaker and communicably coupleable with at least one of the first speaker and the audio source.

A system for playing audio signals from an audio source is also disclosed. The system includes first housing positionable within a first fistula defining a first channel extending through a first pinna of a first ear of a user. The first housing includes a first enclosure defining a first speaker receiving space. A first speaker is positioned within the first speaker receiving space in the first housing. In an engaged position, at least a portion of the first speaker is positioned within the first channel defined by the first fistula in the first pinna of the first ear of the user. A first audio signal receiving member is electrically coupled to the first speaker and communicably coupleable with an audio source.

In certain embodiments, the system also includes a second housing positionable within a second fistula defining a second channel extending through a second pinna of a second ear of a user. The second housing includes a second enclosure defining a second speaker receiving space. A second speaker is positioned within the second speaker receiving space in the second housing. In an engaged position, at least a portion of the second speaker is positioned within the second channel defined by the second fistula in the second pinna of the second ear of the user. A second audio signal receiving member is electrically coupled to the second speaker and communicably coupleable with at least one of the first speaker and the audio source. In one embodiment, the system also includes an audio source communicably coupled to at least one of the first speaker and the second speaker.

Reference throughout this specification to features, advantages, or similar language does not imply that all of the features and advantages that may be realized with the present subject matter should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics of the subject matter may be combined in any suitable manner in one or more embodiments. One skilled in the relevant art will recognize that the subject matter may be practiced without one or more of the specific features or advantages of a particular embodiment. In other instances, additional features and advantages may be recognized in certain embodiments that may not be present in all embodiments of the subject matter.

These features and advantages of the present subject matter will become more fully apparent from the following description and appended claims, or may be learned by the practice of the subject matter as set forth hereinafter.

BRIEF DESCRIPTION OF THE DRAWINGS

In order that the advantages of the present subject matter will be readily understood, a description of the present subject matter will be rendered by reference to specific embodiments that are illustrated in the appended drawings. Understanding that these drawings depict only typical embodiments of the present subject matter and are not therefore to be considered to be limiting of its scope, the present subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present subject matter. Thus, appearances of the phrases "in one embodiment," "in an embodiment," and similar language throughout this specification may, but do not necessarily, all refer to the same embodiment.

Furthermore, the described features, structures, or characteristics of the present subject matter may be combined in any suitable manner in one or more embodiments. In the following description, numerous specific details are provided for a thorough understanding of embodiments of the present subject matter. One skilled in the relevant art will recognize, however, that the present subject matter may be practiced without one or more of the specific details, or with other methods, components, materials, and so forth. In other instances, well-known structures, materials, or operations are not shown or described in detail to avoid obscuring aspects of the present subject matter.

Body piercing has practiced by both males and females in various cultures throughout the world since ancient times. Piercing involves puncturing or cutting a part of the body to create an opening through which jewelry is positioned. The most common type of piercing is ear piercing.

Figure 1A:
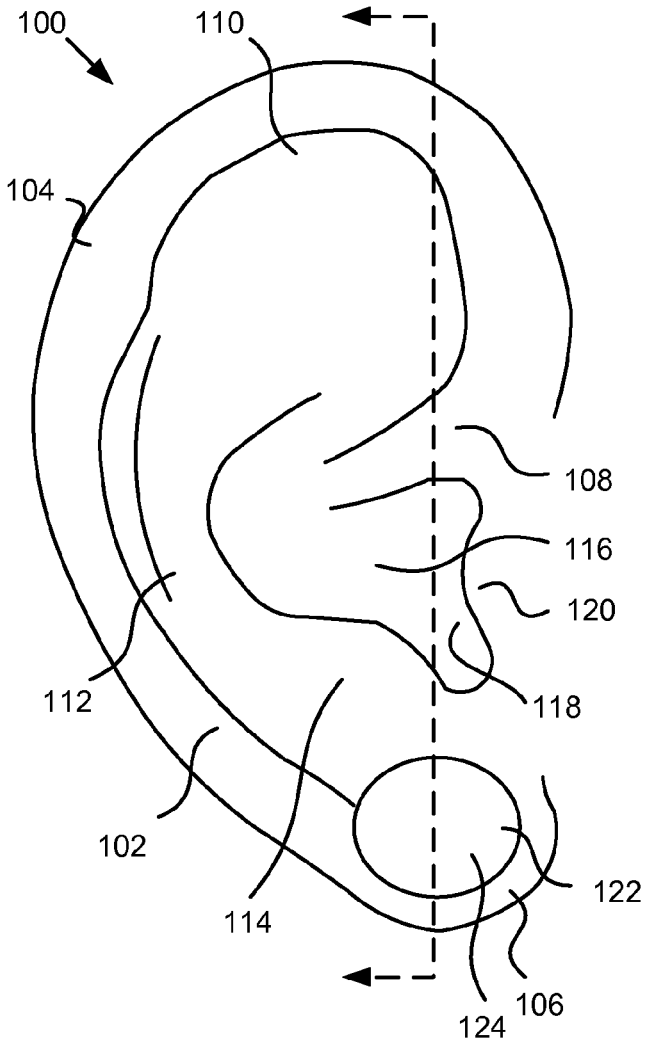
FIG. 1A depicts a side view of the external anatomy of a human ear.

FIG. 1A depicts a side view of the external anatomy of a human ear 100. In medical terminology the external portion or the visible portion of a human ear 100 is termed the pinna, the auricula, or the auricle. For the purpose of the present disclosure, the term pinna 104 will be used to reference the external portion of a human ear 100.

The pinna 104 includes the helix 104 which extends around the periphery of the ear 100 from the lobule 106 to the concha 108 to form the semicircular appendage that is the pinna 104 portion of the ear 100. The skin within the helix 104 is divided into portions defined as the scaphoid fossa 110, the antihelix 112, the anti tragus 114 and the acoustic meatus 116. The small protuberance that extends above the auditory canal 118 is called the tragus 120. Common locations for ear piercing include piercings in the lobule 106, in the antihelix 112, across the helix 104, and through the tragus 120. The most common of these piercings is the lobule 106 piercing.

Ear stretching has also been practiced by both males and females in various cultures throughout the world since ancient times. Ear stretching involves the deliberate expansion of a healed fistula 122 or hole in the skin. While all areas of the pinna 104 of the ear 100 may be stretched to some degree, cartilage piercings are usually more difficult to stretch and are more likely to form scars if stretched quickly. The areas of the pinna 104 of the ear 100 containing cartilage include the scaphoid fossa 110, the antihelix 112, the anti tragus 114, the acoustic meatus 116, and the tragus 120. The lobule 106 does not contain cartilage and therefore, fistula expansion the lobule 106 is more common than fistula expansion in the scaphoid fossa 110, the antihelix 112, the anti tragus 114, the acoustic meatus 116, and the tragus 120.

To stretch a fistula 122 of the user's ear 102, the user first pierces the ear with a standard diameter earring. The fistula 122 is then stretch in small increments over a relatively long period of time to minimize the potential of damaging the healed fistula 122 or creating scar tissue.

The most common technique to stretch a fistula 122 involves the use of a "taper" or conical rod positioned through the piercing. The taper is pushed through the piercing such that the increased diameter of the conical rod forces the fistula 122 to stretch. Tapers come in a variety of sizes which are identified by the diameter of the large end. Typically, in the U.S., the diameter of the large end of the taper is identified using the American Wire Gauge ("AWG") system which is a standardized system for identifying the diameter of a wire.

In the AWG system, diameters are referred to as gauges (abbreviated "g"). The diameter of jewelry having a higher gauge is actually smaller than the diameter of jewelry having a lower gauge. For example, jewelry having an 18 g diameter is equal to jewelry having a diameter of 1.0 mm or 0.0310476 inches while jewelry having a 0 g diameter is equal to jewelry having a diameter of 8.3 mm or 0.4007 inches. The size of the inner diameter of a fistula 122 as well as the diameter of the shaft of jewelry are also identified according to the AWG system.

Other techniques for stretching fistulas 122 include dead stretching, Teflon tape stretching, weighting, scalpelling, scalpelling and tapering, dermal punching, and the use of silicon plugs. With dead stretching, large jewelry is simply forced through an existing piercing. With Teflon tape stretching, existing jewelry is removed and a thin layer of Teflon tape is wrapped around the shaft of the jewelry to increase the diameter of the shaft. The shaft is then reinserted into the piercing to stretch the fistula 122. The process is repeated until the fistula 122 has a desired inner diameter.

To increase the size of the fistula 122 using weights, large jewelry or weighted objects are positioned within the piercing to cause the fistula 122 to stretch over time. With scalpelling, the size of the fistula 122 is increased by cutting the edge of the fistula 122 with a scalpel to increase the diameter of the fistula 122.

The scalpelling and tapering method of increasing the size of a fistula 122 involves removing an area of flesh with a scalpel and then immediately inserting a taper into the fistula 122. This method allows the fistula 122 to instantly be stretched to large diameters.

With the dermal punch method of increasing the size of a fistula 122, a circular razor of the desired diameter is used to remove a small disk of skin. The circular razor is then removed and jewelry is positioned within the hole created by the removal of the disk of skin. This method can be used on the cartilage containing areas such as the scaphoid fossa 110, the antihelix 112, the anti tragus 114, the acoustic meatus 116, and the tragus 120.

To use a silicon plug to increase the size of a fistula 122, a soft malleable silicon plug is folded and inserted into a piercing. Once positioned within the piercing, the resiliency of the silicon plug causes the silicon plug to expand and stretch the fistula 122.

Figure 1B:
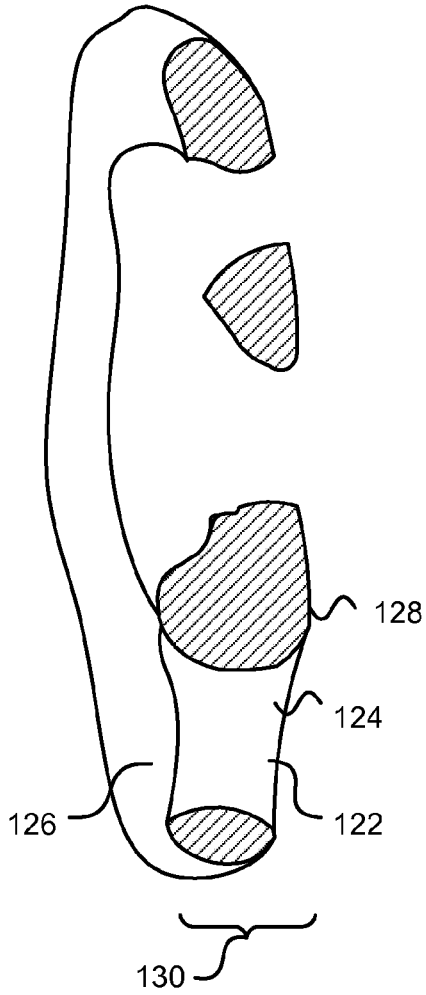
FIG. 1B a cutaway view of the pinna of a human ear.

FIG. 1B a cutaway view of the pinna 104 of a human ear 100 taken along line A-A of FIG. 1A. As can be seen in this depiction, the fistula 122 defines a channel 124 that extends through the pinna 104 of the ear 102 from a first surface 126 to a second surface 128 of the pinna 104. Thus, the channel 124 extends through the entire width 130 of the pinna 104 from the first surface 126 to the second surface 128. The fistula 122, in certain embodiments, can be formed and stretched according to any of the methods described above.

Figure 2:
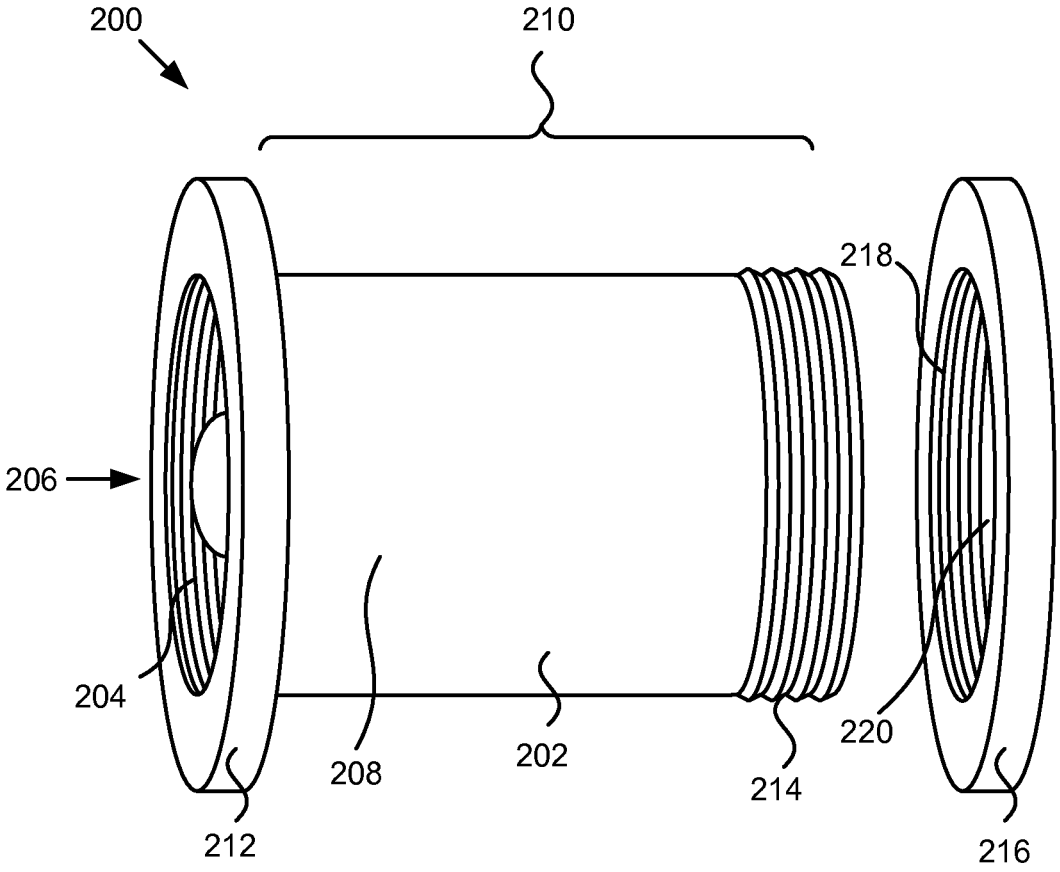
FIG. 2 depicts a side view illustrating one embodiment of an apparatus for playing audio signals from an audio source in accordance with the present subject matter.

FIG. 2 depicts a side view of an apparatus 200 for playing audio signals from an audio source according to one embodiment of the present subject matter. In certain embodiments, the apparatus 200 includes a housing 202 and a speaker 204 positioned within the housing 202.

The housing 202 is positionable within the channel 124 defined by the fistula 122 disposed in the pinna 104 of the ear 102 of the user. In certain embodiments, the housing 202 is an enclosure 208 that defines a speaker receiving space 206. In the embodiment illustrated in FIG. 2, the housing 202 includes a substantially cylindrical portion 210 and a flanged portion 212. In use, the substantially cylindrical portion 210 is positioned within the channel 124 in the pinna 104 and the flanged portion 212 rests against the first surface 126 of the pinna 104. In one embodiment, the flanged portion 212 has an outer diameter substantially larger than the inner diameter of the fistula 122 to keep the housing 202 from progressing all the way through the fistula 122 in the pinna 104.

In certain embodiments, the housing 202 also includes a plurality of threads 214 disposed on an end of the housing 202 opposite the end having the flanged portion 212. A stopping member 216 having a plurality of corresponding threads 218 may be engaged with the plurality of threads 214 disposed on the housing 202. In one embodiment, the stopping member 216 has an outer diameter substantially larger than the inner diameter of the fistula 122 to keep the housing from being removed from the fistula 122 in the pinna 104 in the opposite direction.

While the embodiment illustrated in FIG. 2 depicts the stopping member as being threadedly coupleable to threads 214 located on the cylindrical portion 210 of the housing, one of skill in the art will recognize that in certain embodiments, the stopping member 216 may be coupleable to the cylindrical portion 210 of the housing in other ways. For example, in one embodiment, the stopping member 216 may be made of a resiliently deformable material, such as rubber, silicone, or any other pliable material. In such an embodiment, the inner diameter 220 of the stopping member 216 may be slightly smaller than the outer diameter of the cylindrical portion 210 of the housing 202 and may be stretched around the outer diameter of the cylindrical portion 210 of the housing 202. The resilient nature of the resiliently deformable material causes the stopping member 216 to be removably coupled to the cylindrical portion 210 of the housing 202 to keep the housing positioned within the fistula 122 in the pinna 104.

In yet another embodiment, both the flanged portion 212 and the stopping member 216 may be threadedly connected to the cylindrical portion 210 of the housing 202. Of course, one of skill in the art will recognize that both the flanged portion 212 and the stopping member 216 may be made of resiliently deformable materials and may be designed to stretch around the cylindrical portion 210 of the housing 202 at either end of the housing 202 to keep the housing 202 positioned within the fistula 122 in the pinna 104.

In other embodiments, the entire housing 202 may be substantially cylindrical without having a flanged portion 212. In such an embodiment, the housing 202 may have a sufficient length such that at least a portion of the housing 202 extends beyond the first surface 126 and the second surface 128 of the pinna 104 to make sure the housing remains positioned within the channel 124 in the pinna 104.

The speaker 204 is positioned within the speaker receiving space 206 in the housing 202. As further discussed below, when the apparatus 200 is positioned in an engaged position within the channel 124 defined by the fistula 122 in the pinna 104 of the ear 102 of the user, at least a portion of the speaker 204 is disposed within the channel 124 between the first surface 126 of the pinna 104 and the second surface 128 of the pinna 104.

Figure 3A:
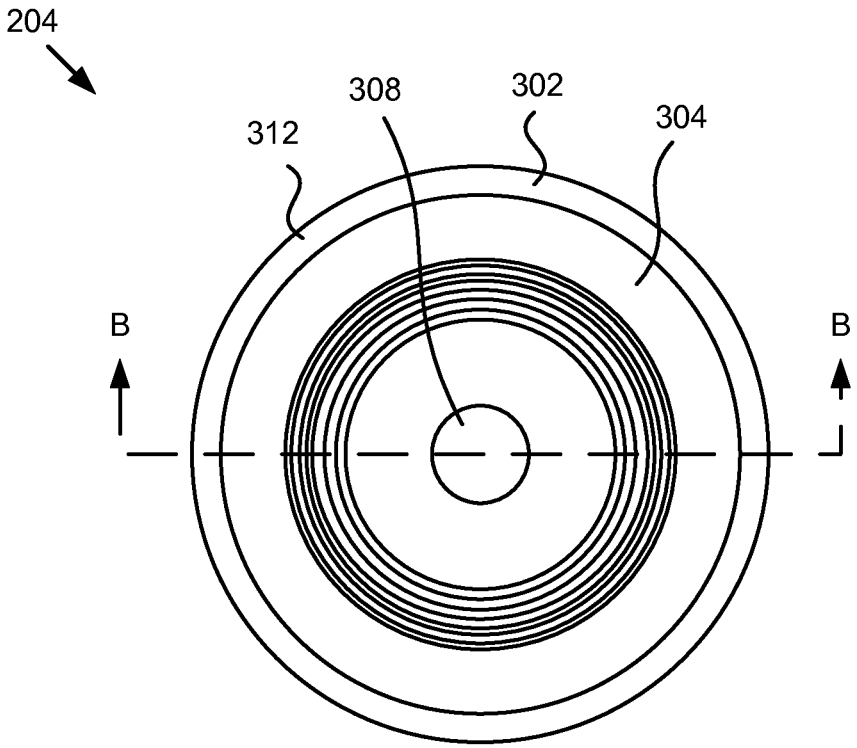
FIG. 3A depicts a top view illustrating one embodiment of a speaker in accordance with the present subject matter.
Figure 3B:
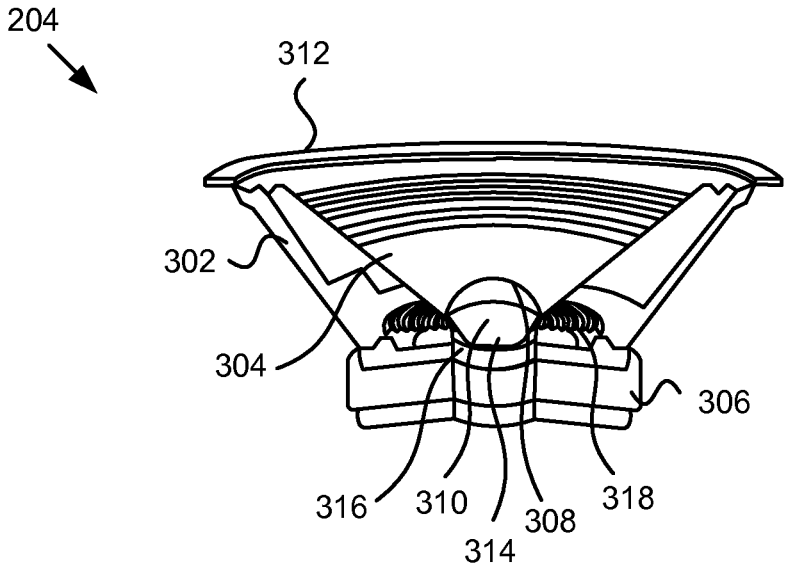
FIG. 3B depicts a cutaway view illustrating one embodiment of a speaker in accordance with the present subject matter.

FIG. 3A depicts a top view of one embodiment of a speaker 204. FIG. 3B depicts a cutaway of a speaker 204 view taken along line B-B of FIG. 3A. As will be evident to a person of skill in the art, a speaker 204 typically includes at least the following elements; a frame structure 302, a cone 304, a magnet 306, a dust cap 308, a voice coil former 314, a voice coil 316, and a suspension 318.

The frame structure 302 provides a rigid structure to which the other components are mounted. The frame structure 302 is typically made with a high degree of precision so that all of the other components are aligned properly. The top portion 312 of the frame structure 302 defines a circular ring that encircles the cone 304 of the speaker 204. The cone 304 is affixed to the top portion 312 of the frame structure 302.

The cone 304 or diaphragm moves like a piston to pump air and create sound waves. The dust cap 308 covers the hole 310 in the center of the cone 304 and reduces the amount of dust and dirt that can get into the voice coil former 314. The dust cap 308 may also add strength to the cone 304 to help maintain the shape of the cone 304.

The magnet 306 provides a stationary magnetic field to oppose an alternating electromagnetic field of the voice coil 316 and thereby cause the cone 304 to move inward and outward to create sound waves. The suspension 318 centers (both axially and front-to-back) the voice coil 316 and voice coil former 314 in the center of the magnet 306 and exerts a restoring force to reposition the voice coil 316 and voice coil former 314 in the center of magnet 306.

One of skill in the art will recognize that in certain embodiments, depending on the frequency range of the speaker 204, the speaker 204 may include other elements. Further, one of skill in the art will recognize that in other embodiments, the elements of the speaker 204 may be arranged differently without departing from the scope of the present disclosure.

Figure 4:
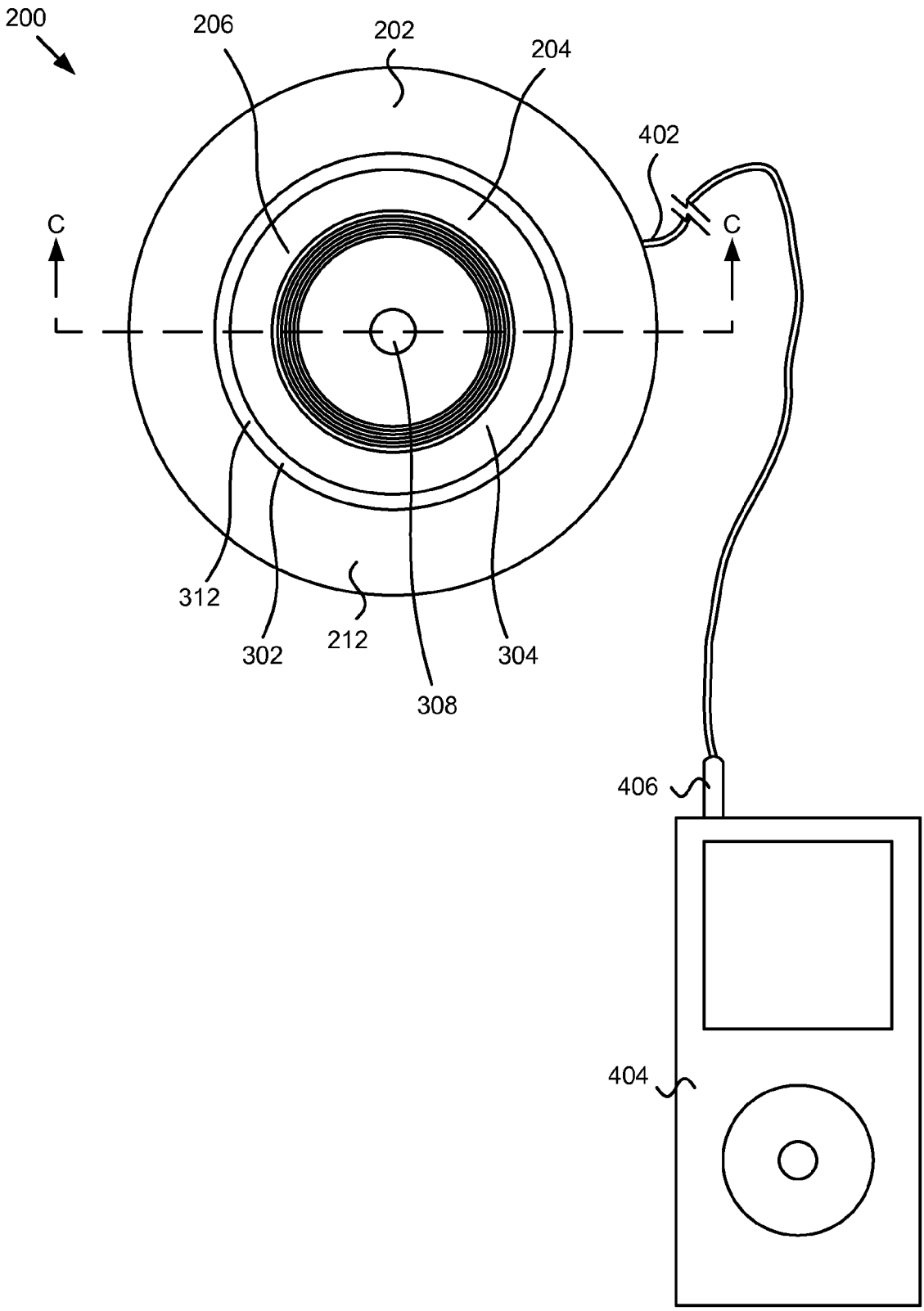
FIG. 4 depicts a top view illustrating one embodiment of an apparatus for playing audio signals from an audio source in accordance with the present subject matter.

FIG. 4 depicts a top view illustrating an apparatus 200 for playing audio signals from an audio source according to one embodiment of the present subject matter. In the embodiment illustrated in FIG. 4, the speaker 204 is positioned within the speaker receiving space 206 in the housing 202.

In certain embodiments, an audio signal receiving member 402 is electrically coupled to the speaker 204. The audio signal receiving member 402 is also coupleable with an audio source 404. In the embodiment illustrated in FIG. 4, the audio signal receiving member 402 is a conventional speaker wire electrically coupled to the speaker 204 at one end and coupleable with the audio source 404 at the other end.

In one embodiment, the audio signal receiving member 402 includes a conventional 3.5 mm speaker jack 406 which is matingly receivable within a corresponding slot in the audio source 404. In other embodiment, the speaker jack 406 may be any other size as long as it is coupleable with the audio source 404. In yet another embodiment, the speaker jack 406 may be positioned on the audio source 404 and a corresponding slot may be coupled to the audio signal receiving member 402 to receive the speaker jack 406 on the audio source 404.

In certain embodiments, as further discussed below, the audio signal receiving member 402 may be a wireless communication module (element 602 of FIG. 6) such as a Bluetooth signal receiving module. In such an embodiment, the wireless communication module 602 may be configured to wirelessly couple with the audio source 404 to receive audio signals from the audio source 404.

Figure 5:
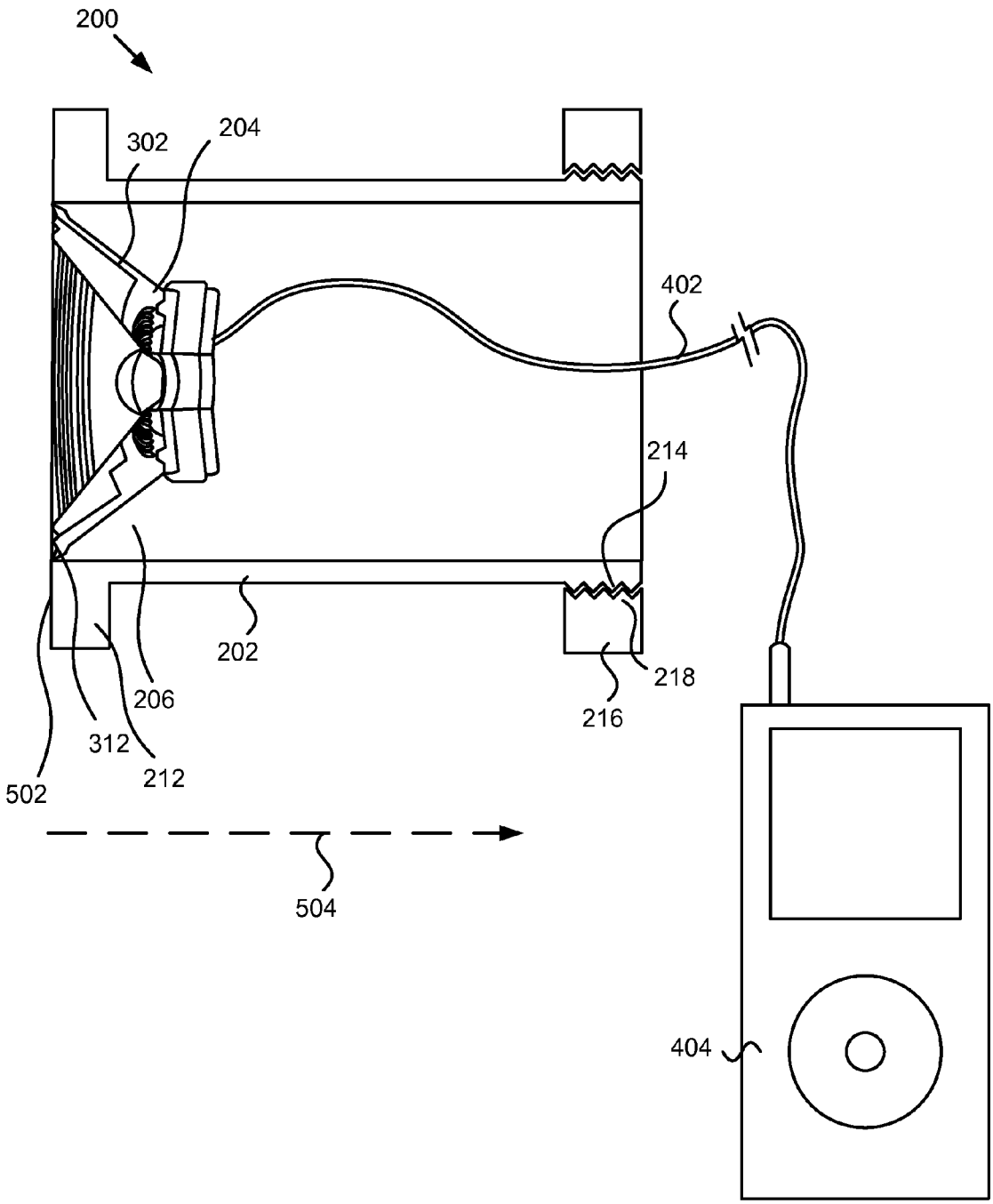
FIG. 5 depicts a side cutaway view illustrating one embodiment of an apparatus for playing audio signals from an audio source in accordance with the present subject matter.

FIG. 5 depicts a side cutaway view illustrating an apparatus 200 for playing audio signals from an audio source taken along line C-C of FIG. 4 according to one embodiment of the present subject matter. In the embodiment illustrated in FIG. 5, the threads 218 of the stopping member 216 are engaged with the threads 214 disposed on the housing 202 to secure the stopping member 216 to the housing 202.

In certain embodiments, the audio signal receiving member 402 is directly electrically coupled to the speaker 204. In other embodiments, the wireless communication module 602 is electrically coupled to the speaker 204. In such an embodiment, the wireless communication module receives a wireless signal (element 604 of FIG. 6) from the audio source 606 and translates the wireless signal 604 to a signal that is usable by the speaker 204.

In the embodiment illustrated in FIG. 5, the top portion 312 of the frame structure 302 of the speaker 204 is positioned flush with a top surface 502 of the flanged portion 212 of the housing 202. The other elements of the speaker 204 are positioned within the speaker receiving space 206 in the housing 202. In other embodiments, the top portion 312 of the frame structure 302 of the speaker 204 may be positioned deeper within the speaker receiving space 206 in the direction of arrow 504. In yet another embodiment, the top portion 312 of the frame structure 302 of the speaker 204 may be positioned beyond the top surface 502 of the flanged portion 212 of the housing 202 in a direction opposite the direction of arrow 504. In one embodiment, at least a portion of the speaker 204 is positioned within the speaker receiving space 206 in the housing 202.

Figure 6:
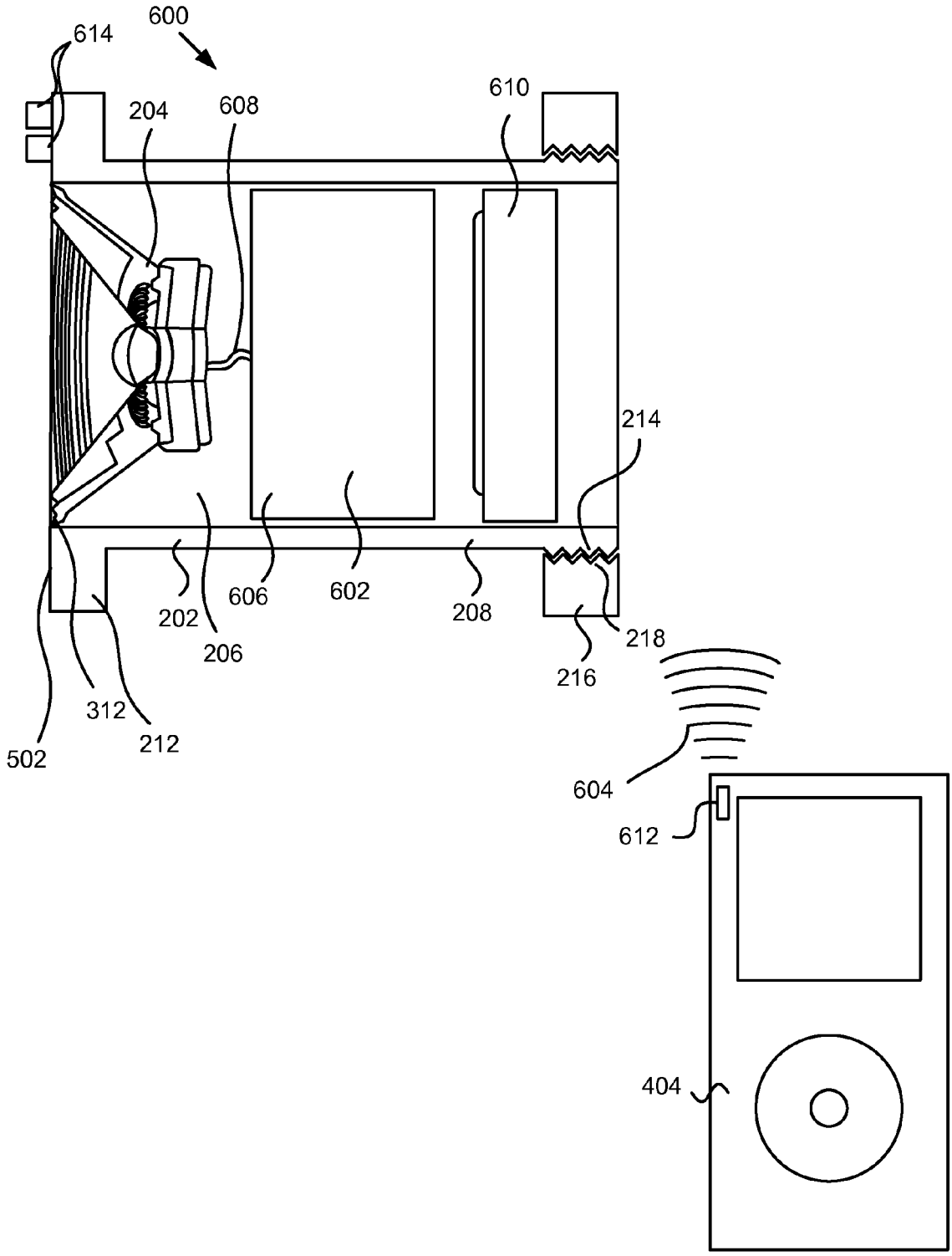
FIG. 6 depicts a side cutaway view illustrating one embodiment of an apparatus for playing audio signals from an audio source in accordance with the present subject matter.

FIG. 6 depicts another side cutaway view of one embodiment of an apparatus 600 for playing audio signals from an audio source. In one embodiment, the apparatus 600 includes a housing 202, a speaker 204, and an audio signal receiving member 606. The housing 202 and the speaker 204, in certain embodiments, are substantially similar to the housing 202 and the speaker 204 of apparatus 200 described above. Thus, in one embodiment, the housing 202 is positionable within a channel 124 defined by a fistula 122 disposed in the pinna 104 of the ear 100 of the user. The housing 202 comprises an enclosure 208 that defines a speaker receiving space 206. In such an embodiment, the speaker 204 is positioned within the speaker receiving space 206 in the housing 202 such that when the apparatus 600 is positioned in an engaged position within the fistula 122, at least a portion of the speaker 204 is positioned within the channel 124 defined by the fistula 122 in the pinna 104 of the ear 100 of the user.

In certain embodiments, as discussed above, the audio signal receiving member 606 is a wireless communication module 602 such as a Bluetooth signal receiving module. In one embodiment, the wireless communication module 602 is positioned within the speaker receiving space 206 in the housing 202 and is electrically coupled to the speaker 204 by at least one lead 608. In such an embodiment, the wireless communication module 602 may be energized by a power source 610 such as a battery. While the embodiments described herein reference the wireless communication module 602 as being a Bluetooth signal receiving module, one of skill in the art will recognize that the wireless communication module 602 may use communication protocols other than Bluetooth.

The wireless communication module 602 is configured to communicate with a wireless signal sending module 612 on the audio source 404 to couple the audio signal receiving member 606 to the audio source 404. The coupling between the audio signal receiving member 606 and the audio source 404 facilitates transfer of a track of sound from the audio source 404 to the speaker 204. The speaker 204 is configured to emit a sound from the track of sound in the conventional manner.

In certain embodiments, the apparatus 600 may include at least one adjusting member 614. In one embodiment, the at least one adjusting member 614 is configured to adjust the volume of sound produced by the speaker 204. In another embodiment, the at least one adjusting member 614 is configured to change the track of sound produced by the speaker 204. Of course, one of skill in the art will recognize that in certain embodiments, the at least one adjusting member 614 may include at least two adjusting members 614 that control both the volume of sound produced by the speaker 204 as well as the track of sound produced by the speaker 204.

Figure 7:
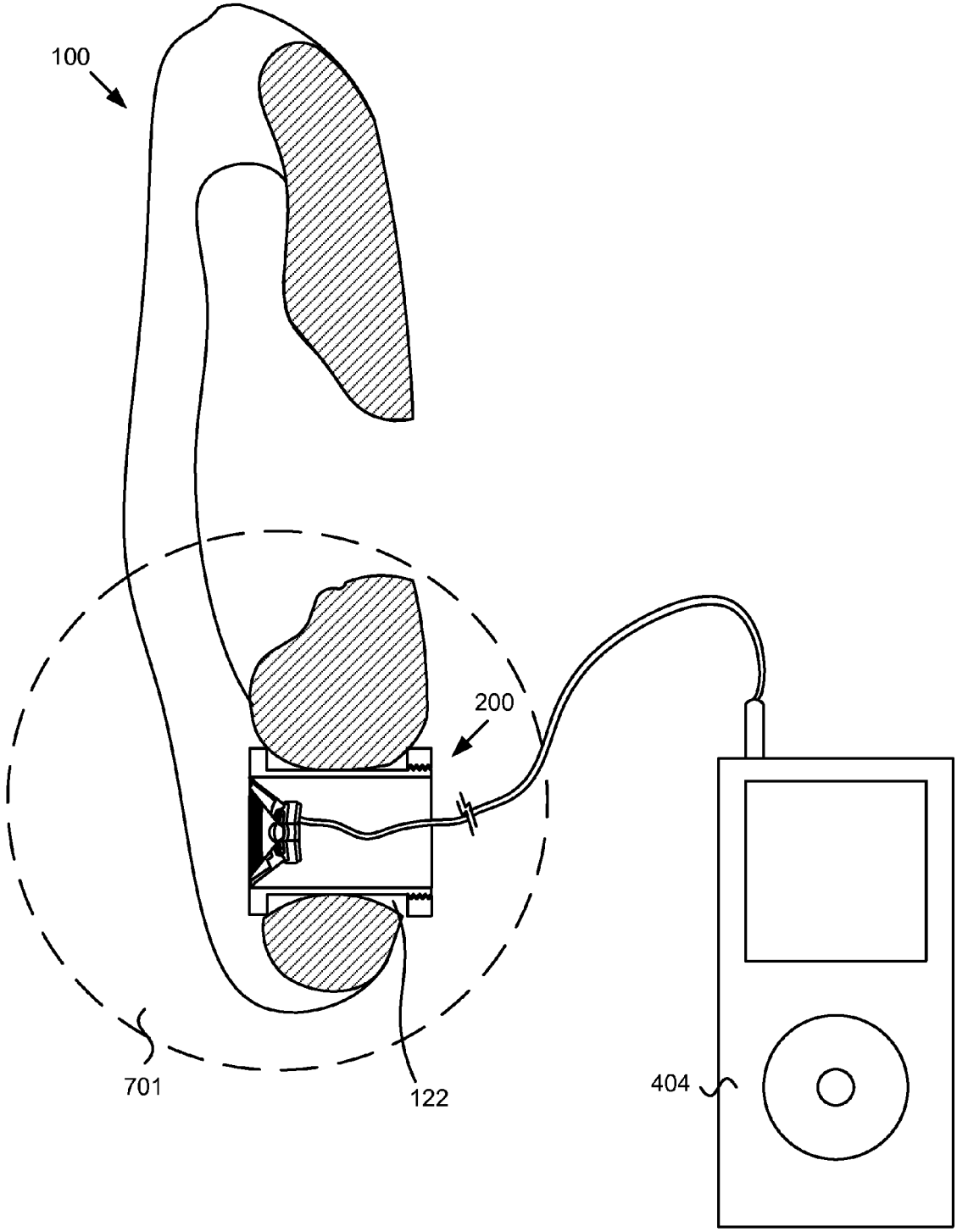
FIG. 7 depicts a side cutaway view illustrating one embodiment of an apparatus for playing audio signals from an audio source positioned in the engaged position within the fistula in the ear of the user in accordance with the present subject matter.

FIG. 7 depicts a side cutaway view of one embodiment of an apparatus 200 for playing audio signals from an audio source positioned in the engaged position within the fistula 122 in the ear 100 of the user. While the embodiment illustrated in FIG. 7 depicts the apparatus 200 as being positioned within the fistula 122, one of skill in the art will recognize that the apparatus 600 described above may be positioned within the fistula 122 in substantially the same manner.

Figure 8:
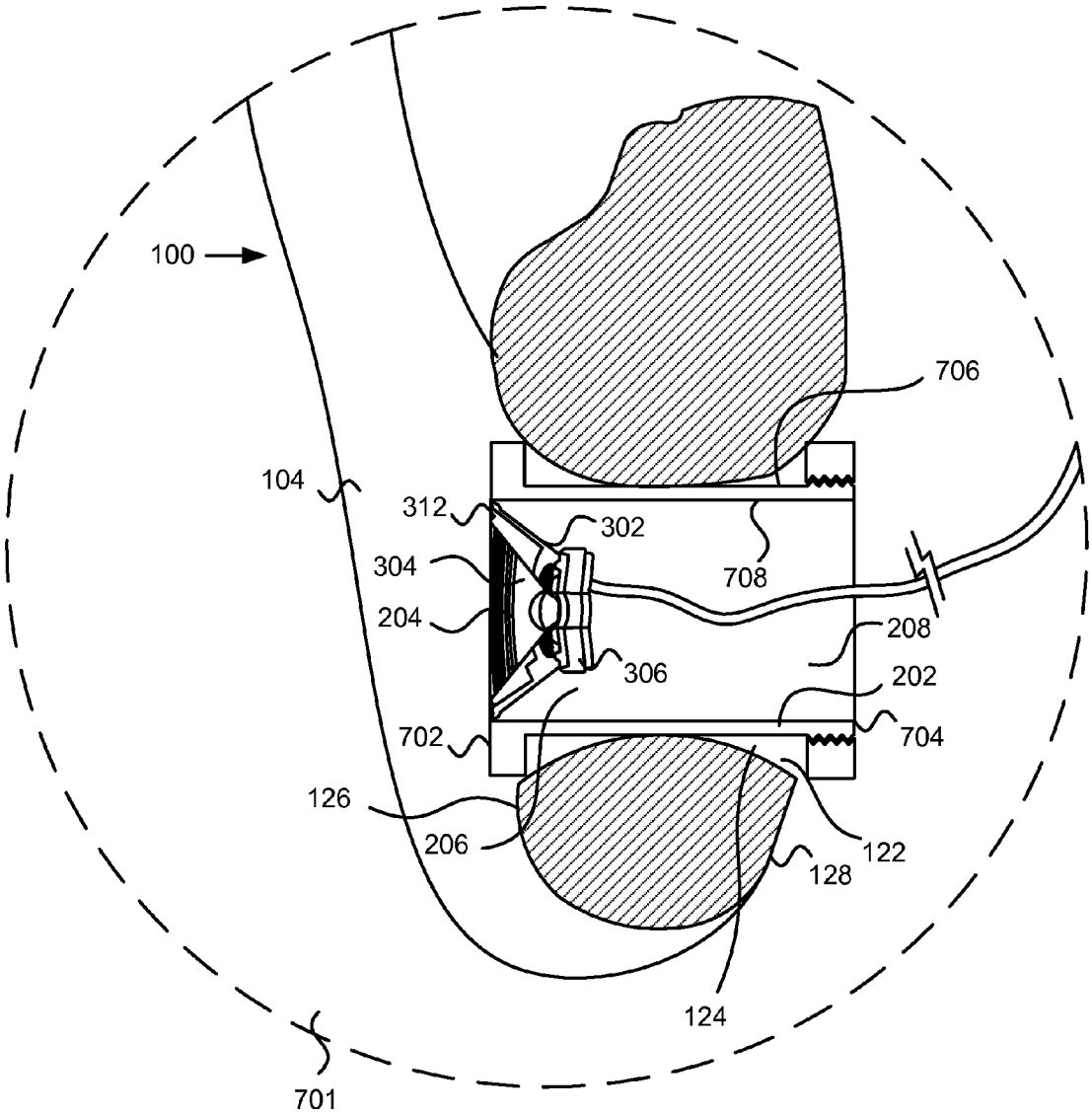
FIG. 8 depicts an enlarged view of a portion of FIG. 7 in accordance with the present subject matter.

FIG. 8 depicts an enlarged view of portion 701 of FIG. 7. As is more clearly illustrated in FIG. 8, in certain embodiments, the housing 202 includes a first end 702 opposing a second end 704 with the enclosure 208 extending between the first end 702 and the second end 704. The enclosure 208 has a fistula engaging surface 706 opposing a speaker receiving surface 708. The speaker receiving surface 708 defines the speaker receiving space 206.

In one embodiment, in the engaged position, the first end 702 of the housing 202 extends beyond the first surface 126 of the pinna 104 and the second end 704 of the housing 202 extends beyond the second surface 128 of the pinna 104. In such an embodiment, at least a portion of the speaker 204 is positioned between the first surface 126 and the second surface 128 of the pinna 104. For example, in the embodiment illustrated in FIG. 7, the top portion 312 of the frame structure 302 of the speaker 204 extends beyond the first surface 126 of the pinna 104 while part of the cone 304 and the magnet 306 are positioned within the channel 124 defined by the fistula 122 disposed in the pinna 104 of the ear 100 of the user.

In one embodiment, at least a portion of the cone 304 is positioned within the channel 124 defined by the fistula 122 in the pinna 104 of the ear 100 of the user. In another embodiment, the entire cone 304 is positioned within the channel 124 defined by the fistula 122 in the pinna 104 of the ear 100 of the user. In yet another embodiment, only the magnet 306 and its surrounding structure is positioned within the channel 124 defined by the fistula 122 in the pinna 104 of the ear 100 of the user.

Figure 9A:
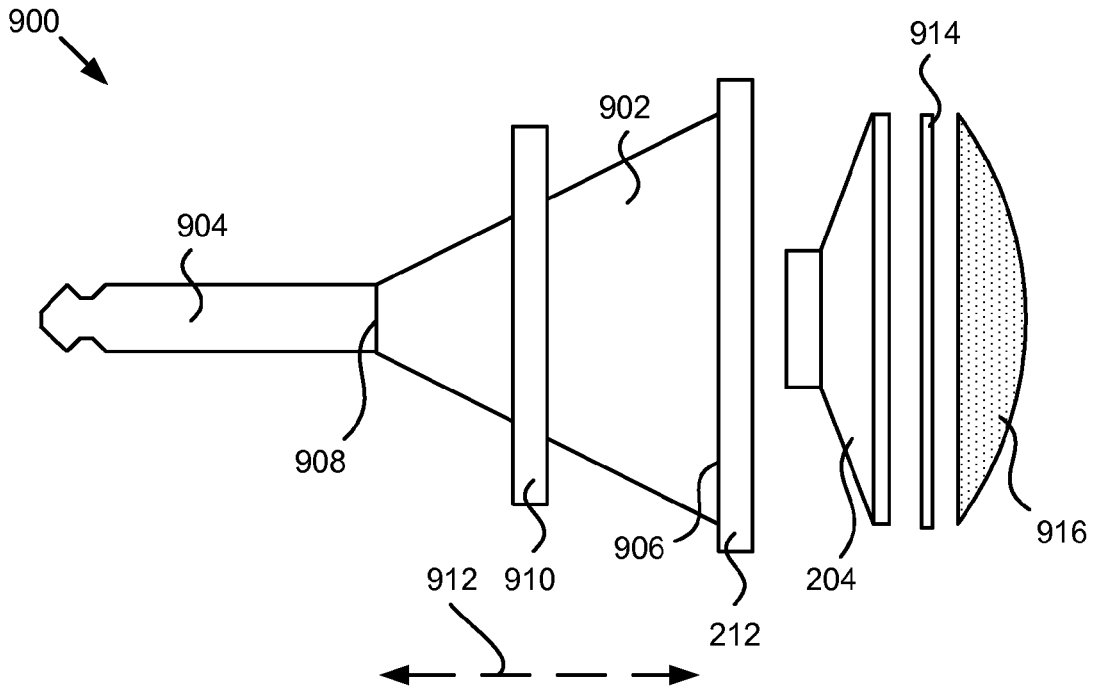
FIG. 9A depicts a side view illustrating one embodiment of an apparatus for playing audio signals from an audio source in accordance with the present subject matter.

FIG. 9A depicts a side view of one embodiment of an apparatus 900 for playing audio signals from an audio source. In certain embodiments, the apparatus 900 includes a housing 902, a speaker 204, and an audio signal receiving member 904. The speaker 204, in one embodiment, may be substantially similar to the speaker 204 described above.

In certain embodiments, the housing 902 may be shaped in a manner substantially similar to the way a taper, described above, is shaped. Thus, in one embodiment, a first end 906 of the housing 902 has a diameter substantially larger than a diameter of the housing 902 at a second end 908. In certain embodiments, the housing 902 may include a flanged portion 212 substantially similar to the flanged portion 212 of housing 202 described above.

In one embodiment, the apparatus 900 may also include a stopping member 910 positionable on and engageable with the housing 902 to keep the housing positioned within the fistula 122. In certain embodiments, the stopping member 910 may be engaged with the housing with threads as described above. In other embodiments, the stopping member 910 may be adjustably engaged with the housing 910 in the directions indicated by arrows 912. By adjusting the position of the stopping member 910, a user can adjust the size of the housing 902 that is actually positioned within the fistula 122 and thereby increase the size of the fistula 122 over time.

In certain embodiments, the apparatus 900 may include a waterproof membrane 914 that is positioned over the speaker 204 to protect the speaker 204 from water. The waterproof membrane 914 may be useful if the user wishes to leave the apparatus 900 positioned within the fistula 122 in the ear 100 of the user when the user showers or bathes.

The apparatus 900, in a further embodiment, may include a cover 916. The cover 916 protects the speaker 204 from physical damage. In certain embodiments, the cover 916 may be ornamented in an aesthetically pleasing manner. In yet another embodiment, the cover 916 may be removable from the housing 902 and interchangeable with a replacement cover (not shown) in case the cover 916 is damaged. The replacement cover, in one embodiment, may have a different ornamentation than the cover 916 such that the look of the apparatus 900 may be changed according to a user's desires or to coordinate with a user's attire.

The audio signal receiving member 904, in certain embodiments, may be directly attached to the second end 908 of the housing 902. In the embodiment illustrated in FIG. 9A, the audio signal receiving member 904 is a male portion of a conventional 3.5 mm audio jack. In other embodiments, the audio signal receiving member 904 may be any other audio jack known in the art. The audio signal receiving member 904 is coupleable with a female portion of an audio jack that is coupled to the audio source such as audio source 404 described above. By directly coupling the audio signal receiving member 904 to the second end 908 of the housing 902, the user may avoid the necessity of threading an audio cable through the fistula 122 in the user's ear 100.

Figure 9B:
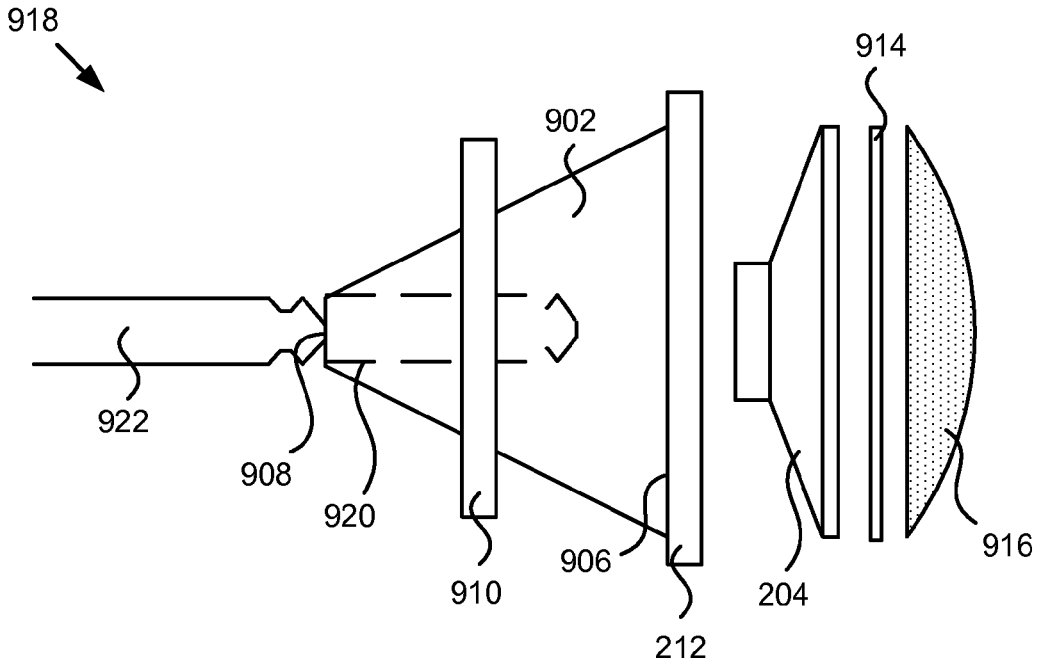
FIG. 9B depicts a side view illustrating one embodiment of an apparatus for playing audio signals from an audio source in accordance with the present subject matter.

FIG. 9B depicts a side view of one embodiment of an apparatus 918 for playing audio signals from an audio source. The apparatus 918 includes a housing 902, a speaker 204, and an audio signal receiving member 920. In certain embodiments, the housing 902 and the speaker 204 may be substantially similar to the housing 902 and the speaker 204 described above.

In one embodiment, the audio signal receiving member 920 may be a female portion of a conventional 3.5 mm audio jack. In the embodiment illustrated in FIG. 9B, the audio signal receiving member 920 is illustrated in dashed lines to indicate that the audio signal receiving member 920 is disposed within the housing 902. The male portion 922 of the conventional 3.5 mm audio jack is inserted into the audio signal receiving member 920 to conduct audio signals from an audio source 404 to the speaker 204.

Figure 10A:
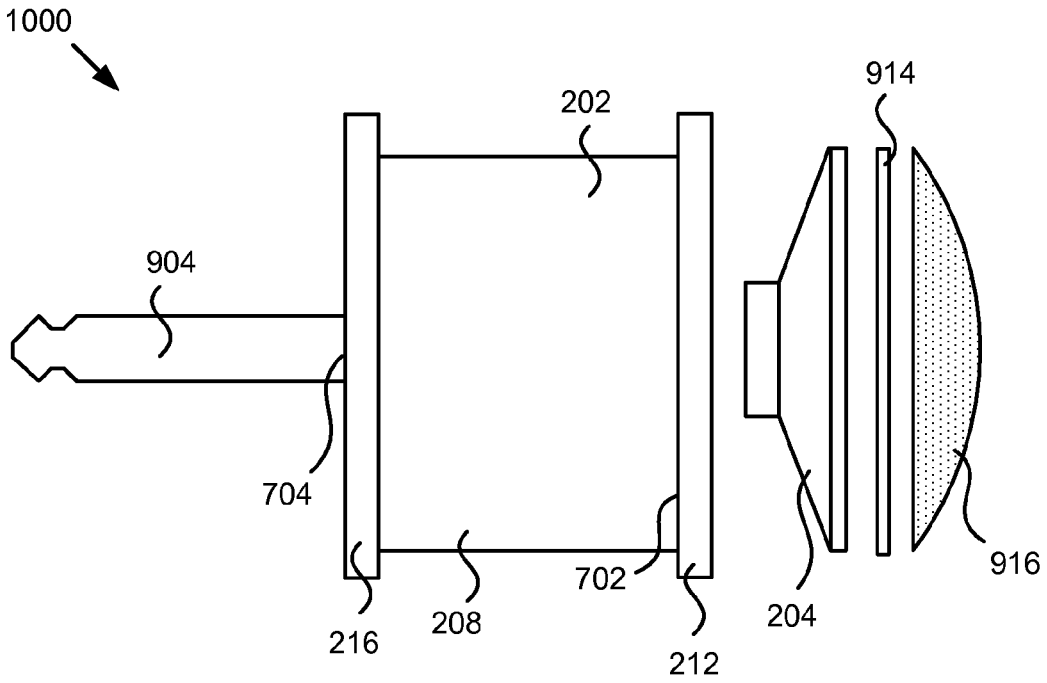
FIG. 10A depicts a side view illustrating one embodiment of an apparatus for playing audio signals from an audio source in accordance with the present subject matter.

FIG. 10A depicts a side view of one embodiment of an apparatus 1000 for playing audio signals from an audio source. The apparatus 1000 includes a housing 202, a speaker 204, and an audio signal receiving member 904. In certain embodiments, the speaker 204 and the audio signal receiving member 904 are substantially similar to the speaker 204 and the audio signal receiving member 904 described above.

The housing 202, in one embodiment, is substantially similar to the housing 202 described above with reference to FIG. 8. Thus, in certain embodiments, the housing 202 has a first end 702 opposing a second end 704 with the enclosure 208 extending between the first end 702 and the second end 704. In certain embodiments, the housing 202 may include a flanged portion 212 and a stopping member 216 to keep the housing 202 positioned within the fistula 122 in the ear 100 of the user.

In the embodiment illustrated in FIG. 10A, the audio signal receiving member 904 is a male portion of a conventional 3.5 mm audio jack that extends from the second end 704 of the housing 202. In other embodiments, the audio signal receiving member 904 may be any audio jack known in the art. By directly coupling the audio signal receiving member 904 to the second end 704 of the housing 202, the user may avoid the necessity of threading an audio cable through the fistula 122 in the user's ear 100.

Figure 10B:
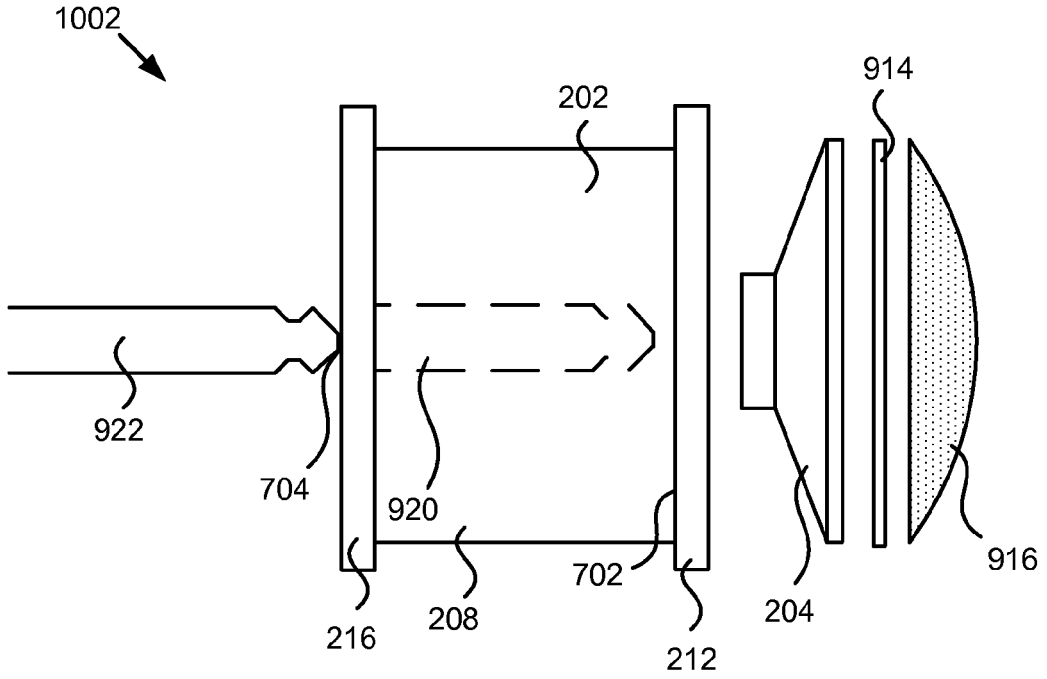
FIG. 10B depicts a side view illustrating one embodiment of an apparatus for playing audio signals from an audio source in accordance with the present subject matter.

FIG. 10B depicts a side view of one embodiment of an apparatus 1002 for playing audio signals from an audio source. The apparatus 1002 is substantially similar to apparatus 1000 except that the audio signal receiving member 920 is a female portion of a conventional audio jack and is configured to receive a male portion 922 of an audio jack. In certain embodiments, an audio signal receiving member 920 that is a female portion of a conventional audio jack may be preferable over a male portion of a conventional audio jack as a male portion of a conventional audio jack may irritate the user's head when the apparatus 1002 is positioned through the fistula 122 in the user's ear 100.

Figure 11:
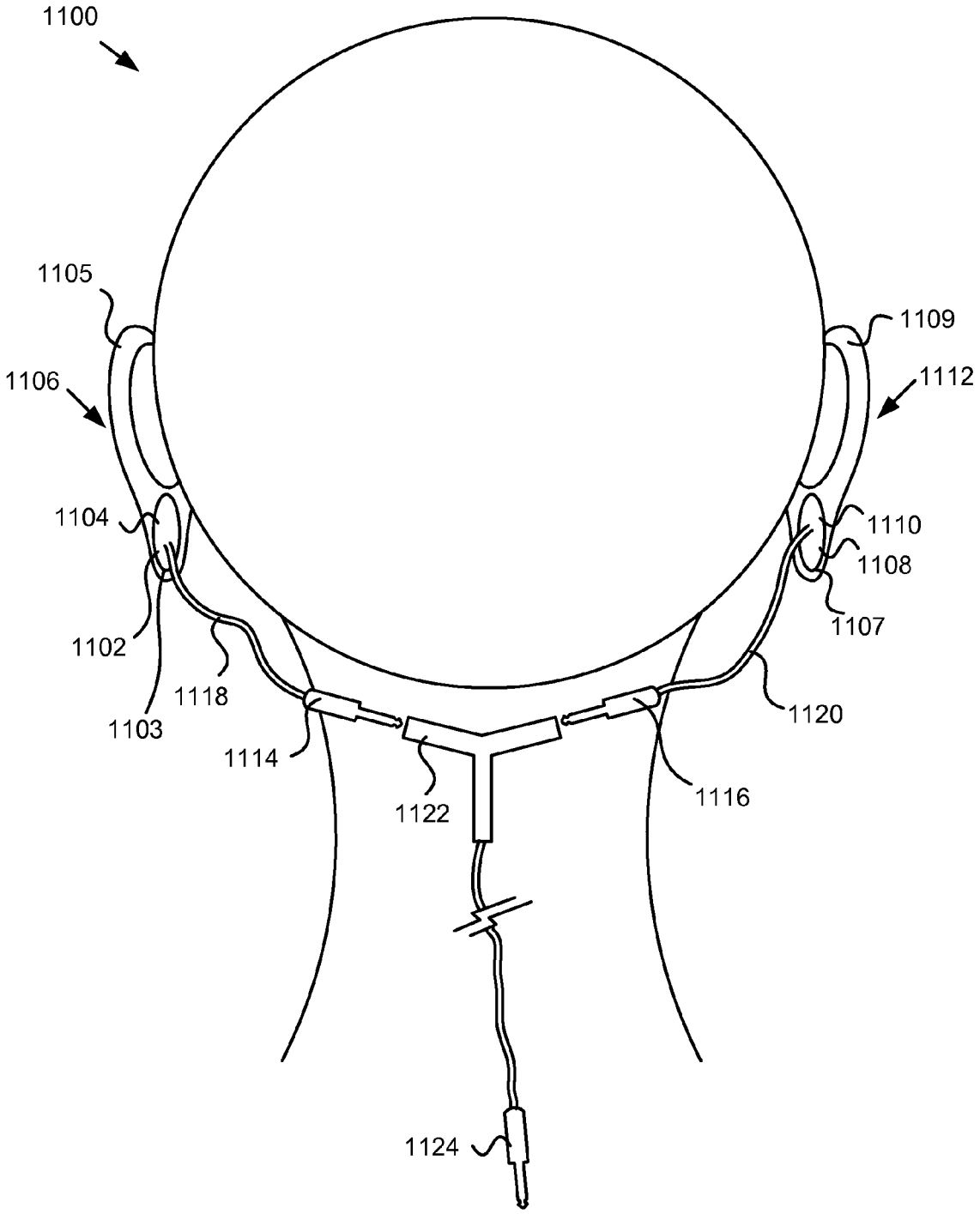
FIG. 11 depicts a rear view illustrating one embodiment of a system for enjoying stereo sound in accordance with the present subject matter.

FIG. 11 depicts a rear view of a system 1100 for enjoying stereo sound. In one embodiment the system 1100 includes a first speaker/housing assembly 1102 positioned in a channel 1103 defined by a first fistula 1104 in a first pinna 1105 of a first ear 1106 of a user and a second speaker/housing assembly 1108 positioned in a second channel 1107 defined by a second fistula 1110 in a second pinna 1109 in a second ear 1112 of a user.

The speaker/housing assemblies 1102 and 1108 of FIG. 1100 are constructed in a substantially similar manner to any of the apparatus 200, 900, 918, 1000, and 1002 described above. Thus, the first speaker/housing assembly 1102 includes a first speaker (not shown) substantially similar to speaker 204 described above and a first housing which may be constructed substantially similar to any of the housings 202 or 902 described above. Similarly, the second speaker/housing assembly 1108 includes a second speaker (not shown) substantially similar to speaker 204 described above and a second housing which may be constructed substantially similar to any of the housings 202 or 902 described above.

The first speaker/housing assembly 1102, in one embodiment, includes a first audio signal receiving member 1114 which is electrically coupled to the first speaker. The second speaker/housing assembly includes a second audio signal receiving member 1116 which is electrically coupled to the second speaker. In certain embodiments, both the first audio signal receiving member 1114 and the second audio signal receiving member 1116 are coupleable with an audio source 404 to receive audio signals.

In one embodiment, the first audio signal receiving member 1114 is a conventional audio jack electrically coupled to the first speaker by an audio wire 1118. Similarly, in one embodiment, the second audio signal receiving member 1116 is also a convention audio jack electrically coupled to the second speaker by an audio wire 1120.

The system 1100, in certain embodiments, may also include a stereo coupler 1122 that receives the first audio signal receiving member 1114 and the second audio signal receiving member 1116 and couples the first audio signal receiving member 1114 and the second audio signal receiving member 1116 to the audio source 404. In one embodiment, the stereo coupler 1122 includes a third conventional audio jack 1124 that is coupleable with the audio source 404.

While the embodiment illustrated in FIG. 11 depicts removable couplings between the first audio signal receiving member 1114, the second audio signal receiving member 1116, the stereo coupler 1122, and the audio source 404, one of skill in the art will recognize that the speakers in each speaker/housing assembly 1102, 1108 may be hardwired to the audio source 404. Further, one of skill in the art will recognize that in certain embodiments each speaker/housing assembly 1102, 1108 may include a wireless communication module 604 that wirelessly communicates with the audio source 404 to receive audio signals. In such an embodiment, the first and second audio signal receiving members 1114 and 1116 respectively and the stereo coupler 1122 may be unnecessary.

Figure 12:
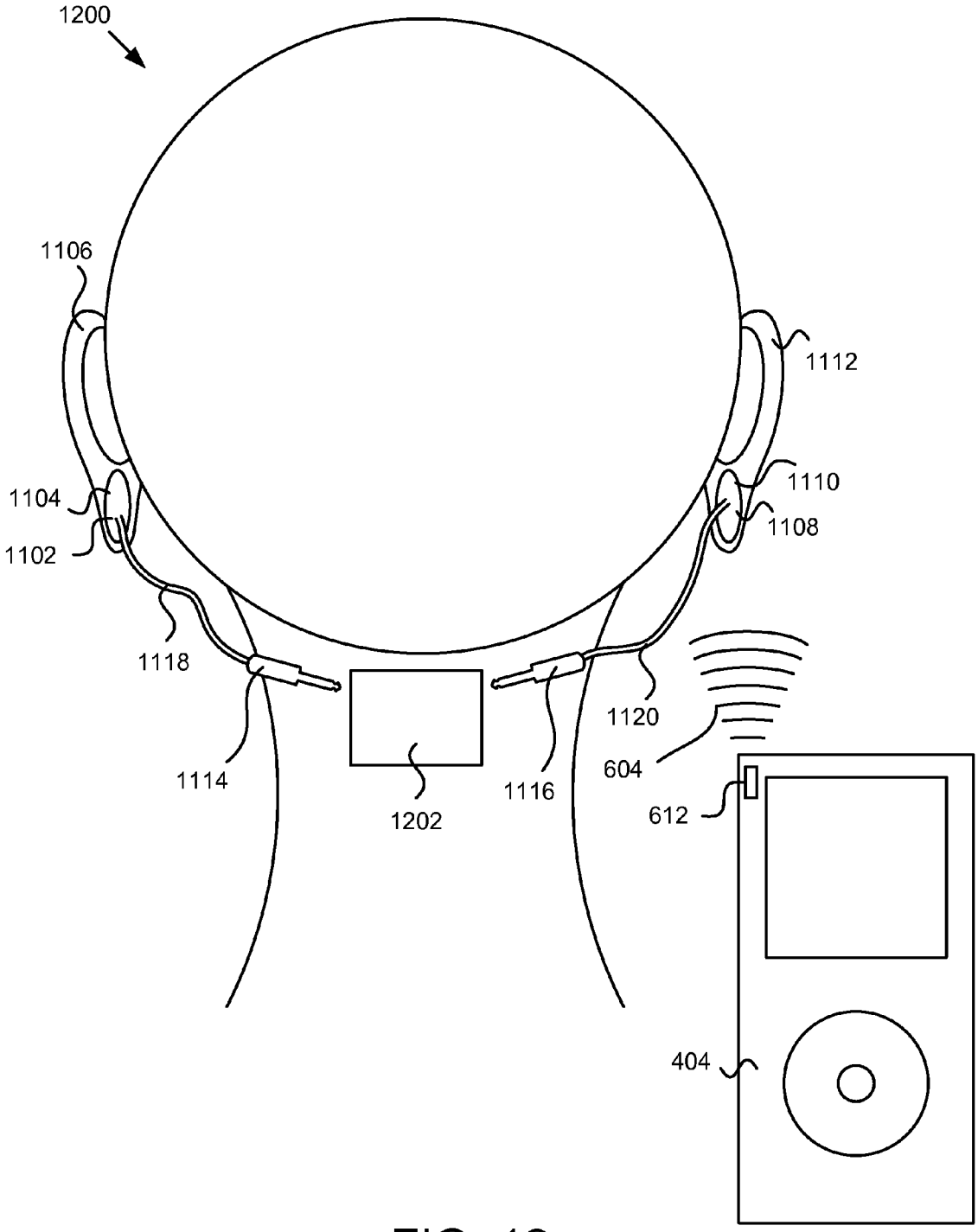
FIG. 12 depicts a rear view illustrating one embodiment of a system for enjoying stereo sound in accordance with the present subject matter.

FIG. 12 depicts a rear view of a system 1200 for enjoying stereo sound. In certain embodiments, the system includes a first speaker/housing assembly 1102 positioned in a first fistula 1104 in a first ear 1106 of a user and a second speaker/housing assembly 1108 positioned in a second fistula 1110 in a second ear 1112 of a user. The first speaker/housing assembly 1102 and the second speaker/housing assembly 1108 are substantially similar to the first speaker/housing assembly 1102 and the second speaker/housing assembly 1108 described above with reference to FIG. 11.

In certain embodiments, speakers (not shown) in the first and second speaker housings assemblies are electrically coupled to a first audio signal receiving member 1114 and a second audio signal receiving member 1116 respectively. The first audio signal receiving member 1114 and the second audio signal receiving member 1116 are coupleable with a separate wireless communication module 1202 that is independent of the speaker/housing assemblies 1102, 1108 and that communicates with the audio source 404 wirelessly. In such an embodiment, the stereo coupler 1122 of FIG. 11 may be replaced with the wireless communication module 1202. The wireless communication module 1202 is independent of the speaker/housing assemblies 1102, 1108 and communicates with the audio source 404 to receive wireless audio signals 604. The wireless communication module 1202 delivers the received audio signals to the speakers within each speaker/housing assembly 1102, 1108 via audio wires 1118 and 1120.

Figure 13:
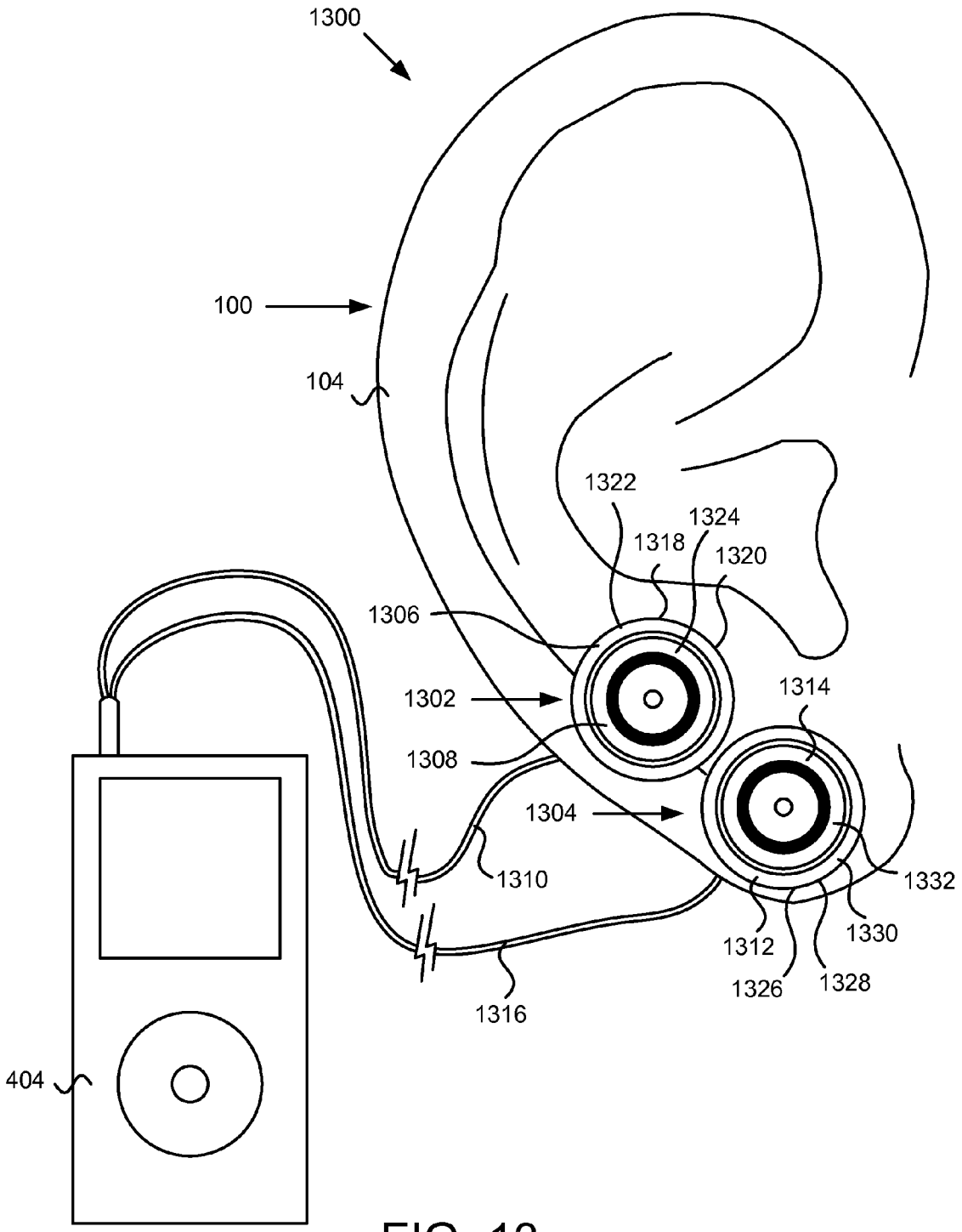
FIG. 13 depicts a side view illustrating one embodiment of a system for playing audio signals from an audio source in accordance with the present subject matter.

FIG. 13 depicts a side view of one embodiment of a system 1300 for playing audio signals from an audio source. In certain embodiments, the system 1300 includes a first speaker/housing assembly 1302 and a second speaker/housing assembly 1304.

The speaker/housing assemblies 1302 and 1304 of FIG. 1300 are constructed in a substantially similar manner to any of the apparatus 200, 900, 918, 1000, and 1002 described above. Thus, in one embodiment, the first speaker/housing assembly 1302 includes a first housing 1306, a first speaker 1308, and a first audio signal receiving member 1310. Similarly, the second speaker/housing assembly 1304 includes a second housing 1312, a second speaker 1314, and a second audio signal receiving member 1316.

The first housing 1306 is positionable within a first channel 1318 defined by a first fistula 1320 disposed in the pinna 104 in the ear 100 of the user. The first housing 1306 includes an enclosure 1322 that defines a speaker receiving space 1324. The first speaker 1308 is positioned within the speaker receiving space 1324 in the first housing 1306 such that, when the first speaker/housing assembly 1302 is positioned in an engaged position within the first channel 1318 defined by the first fistula 1320, at least a portion of the first speaker 1308 is positioned within the first channel 1318.

The second housing 1312 is positionable within a second channel 1326 defined by a second fistula 1328 disposed in the pinna 104 of the ear 100 of the user. The second housing 1312 includes an enclosure 1330 that defines a speaker receiving space 1332 in the second housing 1312. The second speaker 1314 is positioned within the speaker receiving space 1332 in the second housing 1312 such that, when the second speaker/housing assembly 1304 is positioned in an engaged position within the second channel 1326 defined by the second fistula 1328, at least a portion of the second speaker 1314 is positioned within the second channel 1326.

In certain embodiments, the first audio signal receiving member 1310 is electrically coupled to the first speaker 1308 and the second audio signal receiving member 1316 is electrically coupled to the second speaker 1314. The first and second audio signal receiving members 1310 and 1316 are also coupleable with the audio source 404 to receive audio signals from the audio source. In the embodiment illustrated in FIG. 13, the first and second audio signal receiving members 1310 and 1316 are directly and independently coupled to the audio source 404. In other embodiments, one of the speakers 1308 or 1314 may be electrically coupled to the other speaker 1308 or 1314 in a daisy chain-like fashion such that only one of the speakers is directly coupled to the audio source 404. In yet another embodiment, one or both the first speaker/housing assembly 1302 and the second speaker/housing assembly 1304 may include a wireless communication module such as wireless communication module 602 that wirelessly couples the first speaker 1308 and/or the second speaker 1314 to the audio source 404.

In certain embodiments, the first speaker 1308 may be configured to play a first tonal range of sounds and the second speaker 1314 may be configured to play a second tonal range of sounds. In such an embodiment, the first tonal range of sounds may be different than the second tonal range of sounds. For example, in one embodiment, the first speaker 1308 may be configured to produce sounds having a higher pitch than the sounds produced by the second speaker 1314 in a manner similar to the different sounds produced by conventional tweeter and bass speakers.

Figure 14:
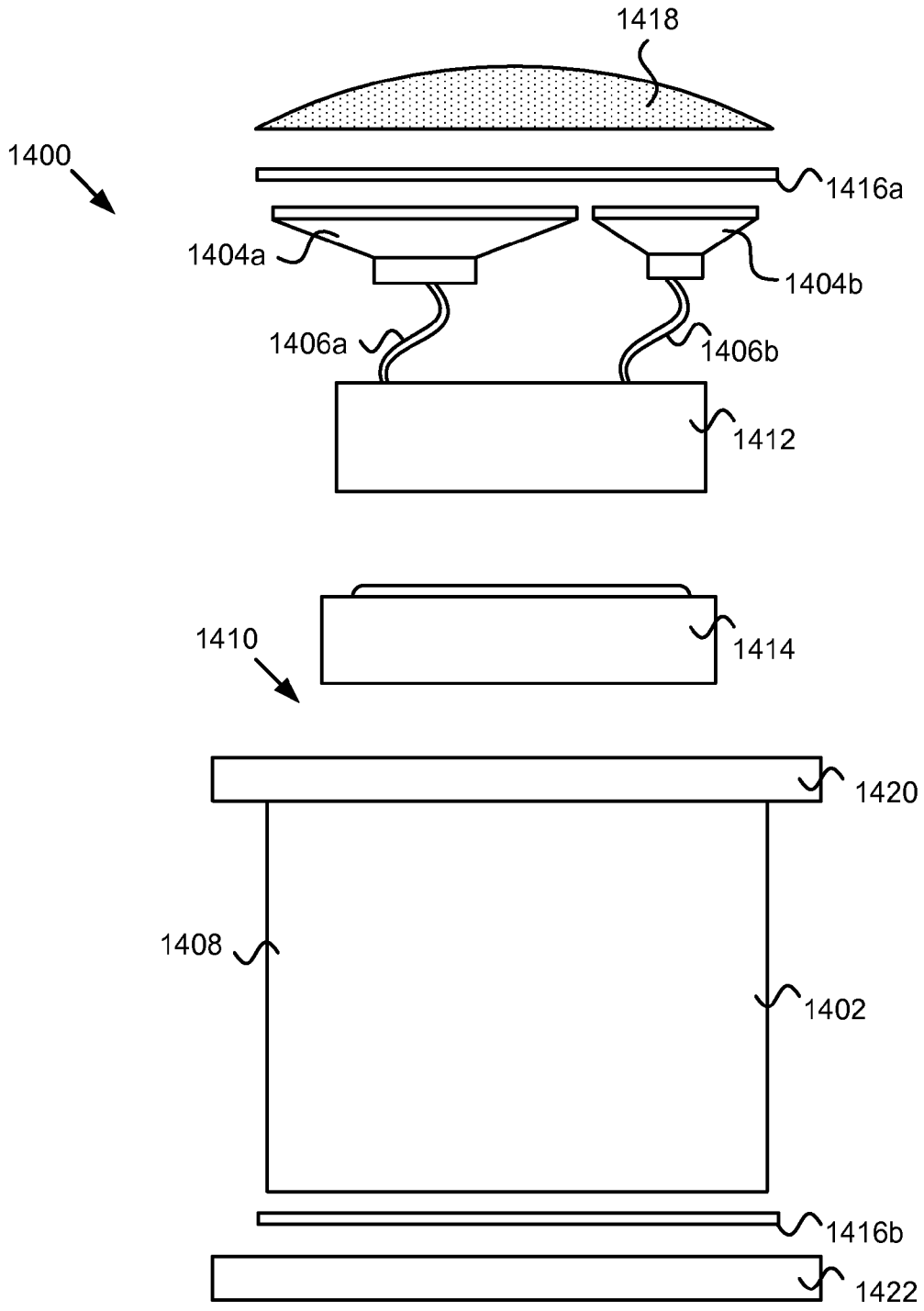
FIG. 14 depicts an exploded view illustrating one embodiment of an apparatus for playing audio signals form an audio source in accordance with the present subject matter.

FIG. 14 depicts an exploded view of one embodiment of an apparatus 1400 for playing audio signals form an audio source. In certain embodiments, the apparatus 1400 includes a housing 1402, at least one speaker 1404*a* and 1404*b*, and at least one audio signal receiving member 1406*a* and 1406*b*.

The housing 1402, in one embodiment, is substantially similar to the housing 202 described above. Thus, the housing 1402 is positionable within the channel 124 defined by the fistula 122 in the pinna 104 of the ear 100 of the user. The housing 1402 comprises an enclosure 1408 that defines a speaker receiving space 1410. In certain embodiments, the housing 1402 includes a flanged portion 1420 at one end of the housing. The apparatus 1400 may also include a stopping member 1422 coupleable to the other end of the housing 1402. The flanged portion 1420 of the housing 1402 and the stopping member 1422 cooperate to keep the housing 1402 positioned within the channel 124 defined by the fistula 122 in the pinna 104 of the ear 100 of the user.

In the embodiment illustrated in FIG. 14, a pair of speakers 1404*a* and 1404*b* are positioned within the speaker receiving space 1410 in the housing 1402. When the housing 1404 is positioned in an engaged position within the channel 124 defined by the fistula 122 in the pinna 104 of the ear 100 of the user, at least a portion of at least one of the speakers 1404*a* and/or 1404*b* is positioned within the channel 124.

In certain embodiments, the speakers 1404*a* and 1404*b* may be configured to play differing tonal ranges of sounds. For example, in one embodiment, speaker 1404*a* may be configured to play a range of relatively high pitched sounds while speaker 1404*b* is configured to play a range of relatively low pitched sounds. In other embodiments, the speakers 1404*a* and 1404*b* may play the same tonal range of sounds.

Each speaker 1404*a* and 1404*b* is electrically coupled to an audio signal receiving member 1406*a* and 1406*b* respectively. The audio signal receiving members 1406*a* and 1406*b* are coupleable with an audio source 1412 to deliver audio signals to the speakers 1404*a* and 1404*b*.

In certain embodiments, the audio source 1412 may be an electronic storage device that is positioned within the speaker receiving space 1410 in the housing 1402. Thus, in one embodiment, the apparatus 1400 is self contained in that both the audio source 1412 and the speakers 1404*a* and 1404*b* are positioned within the housing 1402. In such an embodiment, the apparatus 1400 may include a power source 1414 such as a battery or other electricity storage medium. The power source 1414 powers the apparatus to deliver audio signals from the audio source 1412 to the speakers 1404*a* and 1404*b*.

While the embodiment illustrated in FIG. 14 depicts the audio source 1412 as being positioned within the housing, one of skill in the art will recognize that in other embodiments, the audio source may be a separate unit. In such an embodiment, the apparatus 1400 may include a wireless communication module (not shown) that is coupleable with the independent audio source.

In one embodiment, the apparatus 1400 includes waterproof membranes 1416*a* and 1416*b* positioned on either end of the housing 1402. The waterproof membranes 1416*a* and 1416*b* keep water from infiltrating the speaker receiving space 1410 and damaging the electronics contained therein. In certain embodiments, the apparatus may also include a cover 1418 that protects the speakers 1404*a* and 1404*b* from physical damage.

Figure 15A:
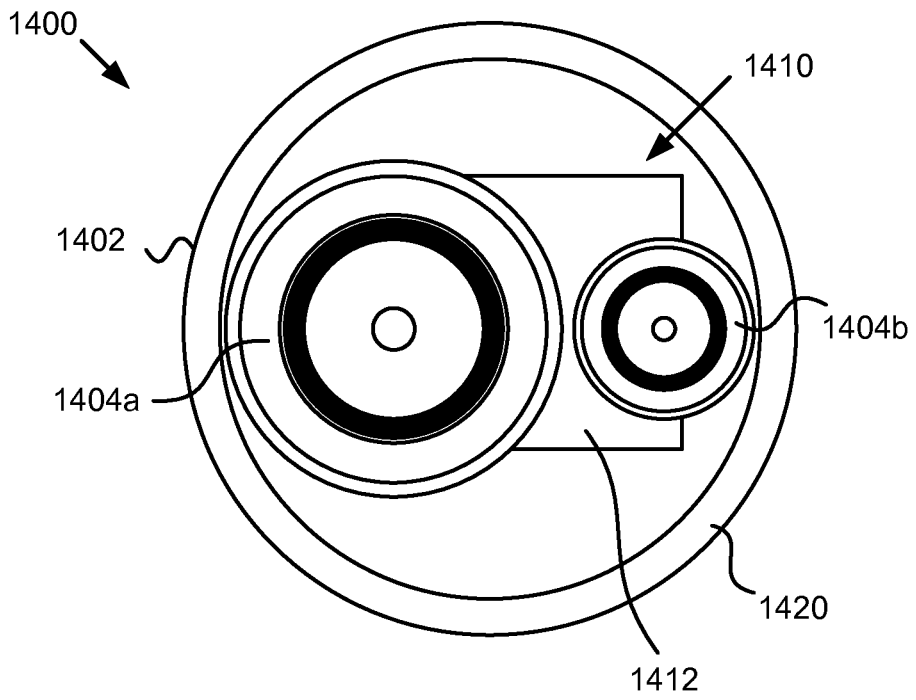
FIG. 15A depicts a top view illustrating one embodiment of an apparatus for playing audio signals form an audio source in accordance with the present subject matter.

FIG. 15A depicts a top view of one embodiment of the apparatus 1400 for playing audio signals form an audio source. In the embodiment illustrated in FIG. 15A, the cover 1418 and the waterproof membrane 1416*a* have been removed such that the speaker receiving space 1410 in the housing 1402 is clearly visible. The audio source 1412 and the speakers 1404*a* and 1404*b* are depicted as being positioned within the speaker receiving space 1410. In certain embodiments, the speakers 1404*a* and 1404*b* may have different sizes to play a differing tonal range of sounds. In other embodiments, the speakers may have substantially the same size.

Figure 15B:
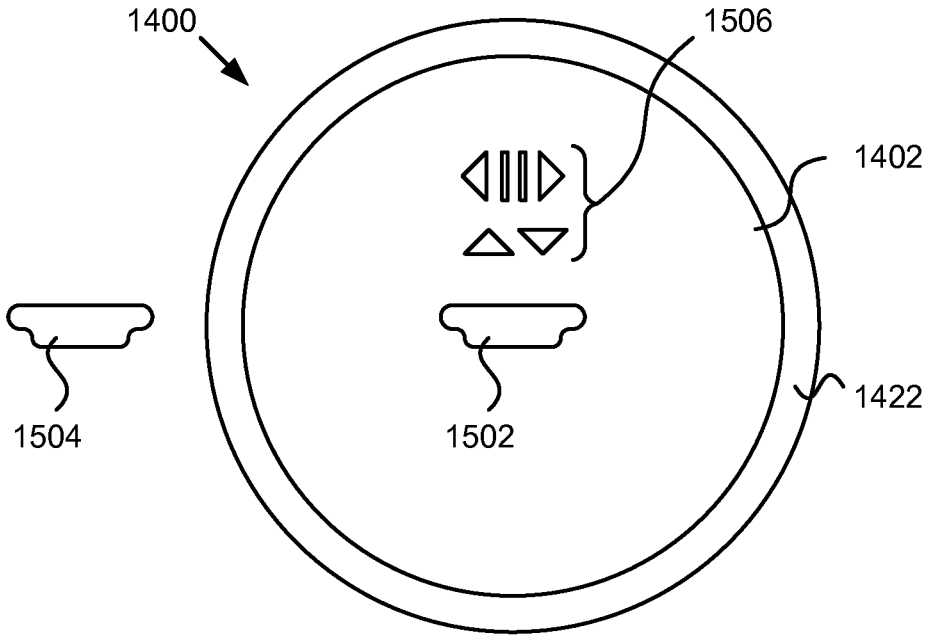
FIG. 15B depicts a bottom view illustrating one embodiment of an apparatus for playing audio signals form an audio source in accordance with the present subject matter.

FIG. 15*b* depicts a bottom view of one embodiment of the apparatus 1400 for playing audio signals form an audio source. As depicted in FIG. 15B, in certain embodiments, the bottom end 1504 of the housing 1402 may be substantially enclosed such that the housing 1402 is cupped-shaped with one end of the housing 1402 being open and the other end of the housing 1402 being enclosed. In such an embodiment, waterproof membrane 1416 may be unnecessary to keep water from infiltrating the speaker receiving space 1410.

In certain embodiments, the apparatus 1400 may include an input port 1502. The input port 1502, in one embodiment, may be used to charge the battery 1414, transfer tracks of sounds to the audio source, or both. A plugging member 1504 may be provided to plug the input port 1502 to keep water from infiltrating the input port 1502. The plugging member 1504, in certain embodiments, may be made from a pliable waterproof material such as a rubber or plastic material.

The apparatus 1400, in one embodiment, may include at least one adjustment member 1506. In certain embodiments, the at least one adjustment member 1506 is configured to adjust a volume of sound emitted from the speakers 1404*a* and 1404*b*. In other embodiments, the at least one adjustment member 1506 is configured to adjust the track of sound that is emitted from the speakers 1404*a* and 1404*b*. For example, where the track of sound emitted from the speakers 1404*a* and 1404*b* is a song, the at least one adjusting member 1506 may be configured to change the track of sound to play a different song. In another embodiment, the at least one adjusting member 1506 may be configured to adjust both the track of sound played by the speakers 1404*a* and 1404*b* as well as the volume of sound played by the speakers 1404*a* and 1404*b*.

In certain embodiments, the apparatus 1400 may be configured to communicate with a second apparatus for playing audio signals form an audio source (not shown). The second apparatus may communicate with the apparatus 1400 through wired or wireless technologies. In either embodiment, the apparatus 1400 and the second apparatus may be positioned in a user's ears 100 to provide stereo sound.

Figure 16:
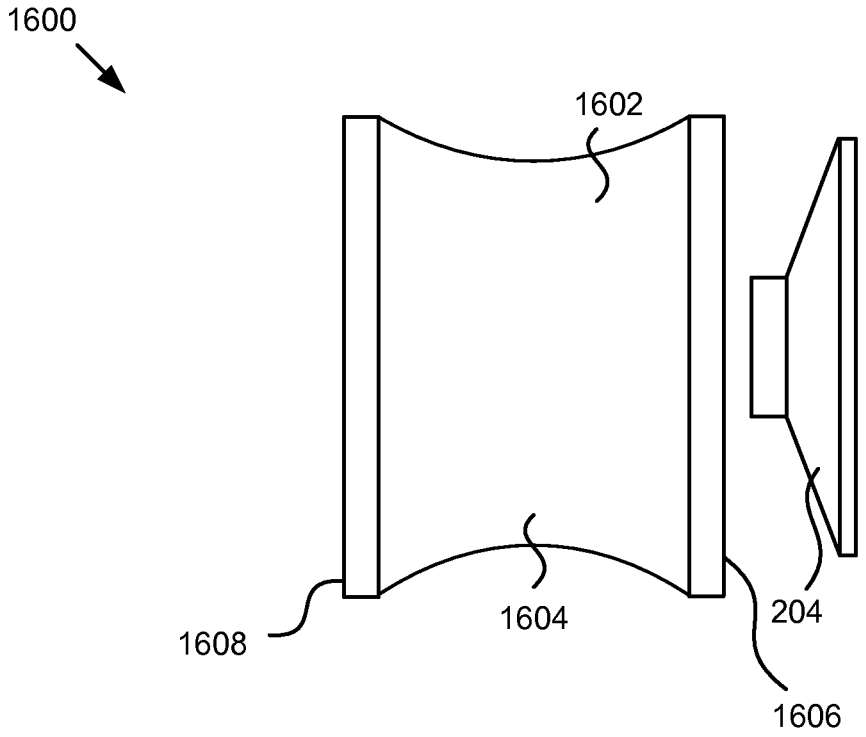
FIG. 16 depicts a side view of one embodiment of an apparatus for playing audio signals form an audio source.

FIG. 16 depicts a side view of one embodiment of an apparatus 1600 for playing audio signals form an audio source. In certain embodiments, the apparatus 1600 includes a housing 202 and a speaker 204 positioned within the housing 1602. The speaker 204 is substantially similar to the speaker 204 described above.

In certain embodiments, the housing 1602 is positionable within the channel 124 that extends through the pinna 104 of the ear 102 of the user. In the embodiment illustrated in FIG. 16, rather than a substantially cylindrical housing 204 as depicted in FIG. 1 and described above, the housing 1602 includes a middle portion 1604 that is tapered such that the middle portion 1604 has a diameter that is substantially smaller than a diameter of the first end 1606 and a diameter of the second end 1608. The increased diameter of the first end 1606 and the second end 1608 operate to keep the apparatus 1600 positioned within the channel 124 in the ear 120 of the user. Thus, in certain embodiments the housing may be a singular component that has enlarged diameters at the first end 1606 and the second end 1608. While the embodiment illustrated in FIG. 16 depicts the middle portion 1604 of the housing 1602 as being tapered, one of skill in the art will recognize that in other embodiments, the first end 1606 and the second end 1608 may include an abrupt change in diameter.

The present subject matter may be embodied in other specific forms without departing from its spirit or essential characteristics. The described embodiments are to be considered in all respects only as illustrative and not restrictive. The scope of the present subject matter is, therefore, indicated by the appended claims rather than by the foregoing description. All changes which come within the meaning and range of equivalency of the claims are to be embraced within their scope.

What is claimed is:

1. An apparatus for playing audio signals from an audio source, the apparatus positionable within a fistula defining a channel extending through a pinna of an ear of a user from a first surface of the pinna to a second surface of the pinna such that the channel extends through an entire width of the pinna, the apparatus comprising:

a housing positionable within the channel defined by the fistula disposed in the pinna of the ear of the user, the housing comprising an enclosure defining a speaker receiving space;

a first speaker positioned within the speaker receiving space in the housing, wherein, in an engaged position, at least a portion of the first speaker is positioned within the channel defined by the fistula disposed in the pinna of the ear of the user; and a first audio signal receiving member electrically coupled to the first speaker, the first audio signal receiving member coupleable with the audio source;

a second speaker, wherein at least a portion of the second speaker is positionable within a second channel defined by a second fistula disposed in a pinna of an ear of the user; and a second audio signal receiving member, the second audio signal receiving member coupleable with the audio source.

2. The apparatus of claim 1, wherein the housing further comprises a first end opposing a second end with the enclosure extending between the first end and the second end, the enclosure having a fistula engaging surface opposing a speaker receiving surface, wherein the speaker receiving surface defines the speaker receiving space.

3. The apparatus of claim 2, wherein, in the engaged position, the first end of the housing extends beyond the first surface of the pinna and the second end of the housing extends beyond the second surface of the pinna.

4. The apparatus of claim 1, wherein, in the engaged position, at least a portion of the speaker is positioned between the first surface of the pinna and the second surface of the pinna.

5. The apparatus of claim 1, wherein the housing is substantially cylindrical.

6. The apparatus of claim 1, wherein the speaker comprises a magnet and a cone, wherein the magnet is positioned within the channel defined by the fistula disposed in the pinna of the ear of the user.

7. The apparatus of claim 6, wherein at least a portion of the cone is positioned within the channel defined by the fistula disposed in the pinna of the ear of the user.

8. The apparatus of claim 7, wherein the entire cone is positioned within the channel defined by the fistula disposed in the pinna of the ear of the user.

9. The apparatus of claim 1, wherein the audio signal receiving member comprises a wireless communication module, the wireless communication module configured to wirelessly couple with the audio source to receive audio signals.

10. The apparatus of claim 1, wherein the audio signal receiving member comprises at least one of a male electrical contact and a female electrical contact, the at least one of the male electrical contact and the female electrical contact matingly coupleable with a corresponding at least one of an audio source male electrical contact and an audio source female electrical contact.

11. The apparatus of claim 1, wherein the first speaker is configured to play a first tonal range of sounds and the second speaker is configured to play a second tonal range of sounds, wherein the first tonal range of sounds is different than the second tonal range of sounds.

12. The apparatus of claim 1 wherein the second channel defined by the second fistula is disposed in a second pinna of a second ear of the user.

13. The apparatus of claim 1, further comprising a waterproof membrane surrounding the speaker.

14. The apparatus of claim 1, further comprising an adjustment member, wherein coupling between the audio signal receiving member and the audio source facilitates transfer of a track of sound from the audio source to the speaker and wherein the speaker is configured to emit a sound, the adjustment member configured to adjust at least one of the track of sound received from the audio source and a volume of the sound emitted from the speaker.

15. An apparatus for playing audio signals from an audio source, the apparatus positionable within a fistula defining a channel extending through a pinna of an ear of a user from a first surface of the pinna to a second surface of the pinna such that the channel extends through an entire width of the pinna, the apparatus comprising:

a housing positionable within the channel defined by the fistula disposed in the pinna of the ear of the user, the housing comprising a first end opposing a second end and an enclosure extending between the first end and the second end, the enclosure having a fistula engaging surface opposing a speaker receiving surface, wherein the speaker receiving surface of the enclosure defines a speaker receiving space, wherein, in an engaged position the first end of the housing extends beyond the first surface of the pinna and the second end of the housing extends beyond the second surface of the pinna;

a first speaker positioned within the speaker receiving space in the housing, wherein, in the engaged position, the first speaker is positioned between the first surface of the pinna and the second surface of the pinna;

a first audio signal receiving member electrically coupled to the first speaker, the first audio signal receiving member coupleable with the audio source;

a second speaker, wherein at least a portion of the second speaker is positionable within a second channel defined by a second fistula disposed in a pinna of an ear of the user; and a second audio signal receiving member, the second audio signal receiving member coupleable with the audio source.

16. The apparatus of claim 15, wherein the housing comprises a first housing and wherein the apparatus further comprises:

a second housing positionable within a second channel defined by a second fistula disposed in a second pinna of a second ear of the user, the second housing comprising a second enclosure defining a second speaker receiving space;

the second speaker positioned within the second speaker receiving space in the second housing, wherein, in the engaged position, at least a portion of the second speaker is positioned within the second channel in the second ear of the user; and wherein the second audio signal receiving member is coupleable with at least one of the first speaker and the audio source.

* * * * *